US009827773B2

(12) United States Patent
Mizutani et al.

(10) Patent No.: US 9,827,773 B2
(45) Date of Patent: Nov. 28, 2017

(54) LIQUID SUPPLY UNIT HAVING AN ENGAGEMENT STRUCTURE FOR ENGAGING A LIQUID ENGAGEMENT DEVICE

(71) Applicant: SEIKO EPSON CORPORATION, Tokyo (JP)

(72) Inventors: Tadahiro Mizutani, Shiojiri (JP); Atsushi Kobayashi, Matsumoto (JP); Yoshinao Miyata, Matsukawa-mura (JP); Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/397,930

(22) Filed: Jan. 4, 2017

(65) Prior Publication Data

US 2017/0113464 A1 Apr. 27, 2017

Related U.S. Application Data

(62) Division of application No. 14/644,804, filed on Mar. 11, 2015, now Pat. No. 9,566,794.

(30) Foreign Application Priority Data

Mar. 17, 2014 (JP) ..... 2014-053248

(51) Int. Cl.
*B41J 2/175* (2006.01)

(52) U.S. Cl.
CPC ..... *B41J 2/175* (2013.01)

(58) Field of Classification Search
CPC ..... B41J 2/17503; B41J 2/17513; B41J 2/17523; B41J 2/17553; B41J 2/175
See application file for complete search history.

(56) References Cited

U.S. PATENT DOCUMENTS

| | | | |
|---|---|---|---|
| 6,196,670 | B1 | 3/2001 | Saruta |
| 6,371,586 | B1 | 4/2002 | Saruta |
| 6,447,090 | B1 | 9/2002 | Saruta |
| 6,631,967 | B1 | 10/2003 | Saruta |
| 6,971,732 | B1 | 12/2005 | Seshimo et al. |
| 6,995,861 | B1 | 2/2006 | Saruta et al. |
| 8,297,739 | B1 | 10/2012 | Kodama et al. |

(Continued)

FOREIGN PATENT DOCUMENTS

| | | | |
|---|---|---|---|
| JP | 07-108688 | A | 4/1995 |
| JP | 2000-141684 | A | 5/2000 |

(Continued)

*Primary Examiner* — Bradley Thies
(74) *Attorney, Agent, or Firm* — Foley & Lardner LLP

(57) ABSTRACT

A cartridge 4 has liquid supply ports 407*b*, 407*c*, 407*y* and 407*m* formed on a bottom wall 422 of a casing 420 and configured to be in contact with corresponding liquid introducing parts 710*b*, 710*c*, 710*y* and 710*m* of a carriage 8. An engagement part 405 is provided on a mounting structure 411 and extends out from a second end wall surface portion 423*b* of a first end wall 423 intersecting with bottom wall 422. The engagement part is configured to engage the carriage 8. In a plan view of bottom wall 422 of cartridge 4 in a first direction toward bottom wall 422, the distance between a second end wall 424 and a first end wall surface portion 423*a* of first end wall 423 is set to be greater than the distance between the second end wall 424 and the second end wall surface portion 423*b*.

5 Claims, 20 Drawing Sheets

(56) References Cited

U.S. PATENT DOCUMENTS

| | | | |
|---|---|---|---|
| 2002/0057319 | A1 | 5/2002 | Saruta et al. |
| 2003/0007027 | A1 | 1/2003 | Saruta |
| 2003/0058297 | A1 | 3/2003 | Saruta |
| 2003/0197751 | A1 | 10/2003 | Saruta |
| 2007/0176983 | A1 | 8/2007 | Koide |
| 2008/0049080 | A1 | 2/2008 | Hayashi et al. |
| 2008/0049081 | A1* | 2/2008 | Hayashi ..... B41J 2/17513 347/86 |
| 2009/0244217 | A1 | 10/2009 | Inoue et al. |
| 2014/0060693 | A1 | 3/2014 | Nakamura et al. |

FOREIGN PATENT DOCUMENTS

| | | | |
|---|---|---|---|
| JP | 2001-187455 | A | 7/2001 |
| JP | 2003-182118 | A | 7/2003 |
| JP | 2007-090643 | A | 4/2007 |
| JP | 2008-074090 | A | 4/2008 |
| JP | 2008-074100 | A | 4/2008 |
| JP | 2011-235652 | | 11/2011 |

* cited by examiner

LIQUID SUPPLY UNIT HAVING AN ENGAGEMENT STRUCTURE FOR ENGAGING A LIQUID ENGAGEMENT DEVICE

CROSS-REFERENCE TO RELATED APPLICATIONS

This application is a divisional of application Ser. No. 14/644,804, filed on Mar. 11, 2015, which claims priority to Japanese Patent Application No. (JP) 2014-53248 filed on Mar. 17, 2014, entire disclosure of which is incorporated herein by reference for all purposes.

BACKGROUND

The present invention relates to a liquid supply unit.

An ink cartridge (may be simply called "cartridge") allowed to supply ink to a printer as an example of a liquid ejection device has been known conventionally as a liquid supply unit configured to supply a liquid to the liquid ejection device. Recently, a cartridge containing a plurality of different color inks has been proposed and configured such that the respective color inks are supplied through corresponding supply ports to the printer (for example, Japanese Patent Publication (JP 2003-182118A)).

SUMMARY

The above proposed technique is configured to keep waste ink in addition to the plurality of color inks and enhance the attachment to the liquid ejection device such as printer. The proposed technique, however, has the following requirements. The cartridge has an engagement part for engagement of the cartridge and a connection part for transmission of data signals to and from the printer, in addition to a casing for containing ink. Downsizing of the entire cartridge including the engagement part and the connection part would result in downsizing of a cartridge attachment structure of the printer and thereby the entire printer, as well as downsizing of a package for transportation and resource saving.

In the above proposed technique, the engagement part for engagement of the cartridge is provided outside of one side wall of the cartridge. This, however, interferes with downsizing of the entire cartridge by the engagement part-occupying area of the engagement part outside of the side wall. The same applies to the connection part-occupying area of the connection part for transmission of data signals to and from the printer, which is provided outside of the side wall. In the technique proposed in Japanese Patent Publication (JP 2008-74090A), an area provided inside of the cartridge is irrelevant to the structure of containing ink, and a connection part is provided on the wall surface of this area. This, however, interferes with downsizing of the entire cartridge by providing this area irrelevant to the structure of containing ink. In the cartridges of the above proposed configurations, an external force due to, for example, a fall is directly applied to the engagement part and may damage the engagement part. By taking into account these circumstances, there is a need to downsize the entire liquid supply unit such as cartridge. In a liquid supply unit configured to contain and supply a liquid, a liquid ejection device configured to receive supply of a liquid from the liquid supply unit and a system including the liquid supply unit and the liquid ejection device, there are other needs including downsizing, cost reduction, resource saving, easy manufacture and improvement of usability.

In order to solve at least part of the problems described above, the invention may be implemented by aspects described below.

(1) According to one aspect of the invention, there is provided a liquid supply unit configured to supply liquid. The liquid supply unit is mountable to a liquid ejection device comprising a first liquid introducing part, a second liquid introducing part, a third liquid introducing part and a fourth liquid introducing part. The liquid supply unit comprises: a first wall comprising a first liquid supply section configured to be in contact with the first liquid introducing part, a second liquid supply section configured to be in contact with the second liquid introducing part, a third liquid supply section configured to be in contact with the third liquid introducing part and a fourth liquid supply section configured to be in contact with the fourth liquid introducing part; a second wall arranged to intersect with the first wall and configured to have a first portion and a second portion; a third wall arranged to intersect with the first wall and to be opposed to the second wall; and a contact part located on the second portion and configured to be in electrically contact with the liquid ejection device. In a plan view of the first wall in a first direction toward the first wall, a distance between the third wall and the first portion is greater than a distance between the third wall and the second portion. In the liquid supply unit of this aspect, the contact part configured to be in electrically contact with the liquid ejection device is located on the second portion of the second wall. This configuration enables the contact part-occupying area of the contact part outside of the second portion to be overlapped with the range of the difference between the distance from the third wall to the first portion and the distance from the third wall to the second portion in the plan view in the direction. This configuration allows for downsizing of the entire liquid supply unit including the first to the fourth liquid supply sections and the contact part in the plan view in the first direction.

(2) In the liquid supply unit of the above aspect, the first portion may be protruded more than the contact part in a direction from the third wall toward the second wall. This aspect enables the first portion to serve to protect the contact part even when an external force due to, for example, a fall is applied to the second wall side having the first portion.

(3) The liquid supply unit of either of the above aspects may further comprise an engagement part located on the second portion and allowed to engage with the liquid ejection device. This configuration enables the engagement part-occupying area of the engagement part outside of the second portion to be overlapped with the range of the difference between the distance from the third wall to the first portion and the distance from the third wall to the second portion in the plan view in the direction. This configuration allows for downsizing of the entire liquid supply unit including the first to the fourth liquid supply sections and the contact part in the plan view in the first direction and additionally enables the first portion to serve to protect the contact part and the engagement part.

(4) According to another aspect of the invention, there is provided a liquid supply unit configured to supply liquid. The liquid supply unit is mountable to a liquid ejection device having a first liquid introducing part, a second liquid introducing part, a third liquid introducing part, a fourth liquid introducing part and an engagement arm. The engagement arm is configured to be rotated and displaced to be engaged with the liquid supply unit. The liquid supply unit comprises: a first wall having a first liquid supply section configured to be in contact with the first liquid introducing part, a second liquid supply section configured to be in contact with the second liquid introducing part, a third liquid supply section configured to be in contact with the third liquid introducing part and a fourth liquid supply section configured to be in contact with the fourth liquid introducing part; a second wall arranged to intersect with the first wall and configured to have a first portion and a second portion; a third wall arranged to intersect with the first wall and to be opposed to the second wall; and an engagement part located on the second portion and allowed to engage with the engagement arm. In a plan view of the first wall in a first direction toward the first wall, a distance between the third wall and the first portion is greater than a distance between the third wall and the second portion. In the liquid supply unit of this aspect, the engagement part allowed to engage with the liquid ejection device is located on the second portion of the second wall. This configuration enables the engagement part-occupying area of the engagement part outside of the second portion to be overlapped with the range of the difference between the distance from the third wall to the first portion and the distance from the third wall to the second portion in the plan view in the direction. This configuration allows for downsizing of the entire liquid supply unit including the first to the fourth liquid supply sections and the engagement part in the plan view in the first direction.

(5) In the liquid supply unit of any of the above aspects, in a course of attachment of the liquid supply unit to the liquid ejection device, the third wall may have a supporting point at which the liquid supply unit is rotated and moved with respect to the liquid ejection device. In the plan view of the first wall in the direction toward the first wall, the first liquid supply section and the third liquid supply section may be located between the third wall and the first portion, and the second liquid supply section and the fourth liquid supply section may be located between the third wall and the second portion. A length of the fourth liquid supply section in a second direction from the third wall toward the second wall may be longer than a length of the second liquid supply section in the second direction. This configuration provides the following advantages. The fourth liquid supply section near to the supporting point comes into contact with the fourth liquid introducing part in the initial stage of attachment to the liquid ejection device, i.e., in the stage having the large moving amount of the liquid supply unit. This provides the long distance of friction against the fourth liquid introducing part in the second direction. The second liquid supply section farther from the supporting point, on the other hand, comes into contact with the second liquid introducing part in the final stage of attachment to the liquid ejection device, i.e., in the stage having the small moving amount of the liquid supply unit. This provides the short distance of friction against the second liquid introducing part in the second direction. Setting the length of the fourth liquid supply section in the second direction to be longer than the length of the second liquid supply section in the second direction can respond to the longer distance of friction. This ensures the contact of the second liquid supply section farther from the supporting point with the second liquid introducing part.

(6) The liquid supply unit of any of the above aspect may further comprise: a first liquid chamber connected with the first liquid supply section; a second liquid chamber connected with the second liquid supply section; a third liquid chamber connected with the third liquid supply section; and a fourth liquid chamber connected with the fourth liquid supply section. The first liquid chamber may have a larger capacity than capacity of the second liquid chamber. This configuration allows for downsizing of the entire liquid supply unit with the difference in capacities of the liquid chambers.

(7) The liquid supply unit of any of the above aspect may further comprise: a first liquid chamber connected with the first liquid supply section; a second liquid chamber connected with the second liquid supply section; a third liquid chamber connected with the third liquid supply section; and a fourth liquid chamber connected with the fourth liquid supply section. The first liquid chamber, the third liquid chamber and the fourth liquid chamber may have larger capacities than capacity of the second liquid chamber. The first liquid chamber, the third liquid chamber and the fourth liquid chamber may contain color inks, and the second liquid chamber may contain black ink. In color printing using a plurality of different color inks, the amounts of consumption of the color inks, i.e., magenta ink, yellow ink and cyan ink, are generally larger than the amount of consumption of black ink. In the liquid supply unit of this aspect, black ink is contained in the second liquid chamber of the smaller capacity, and the color inks are contained in the first, the third and the fourth liquid chambers of the larger capacities than the capacity of the second liquid chamber. This configuration allows for downsizing of the entire liquid supply unit and additionally enhances the flexibility of color printing.

(8) The liquid supply unit of either of the above aspect, in the plan view of the first wall in the first direction, the first liquid chamber, the third liquid chamber and the fourth liquid chamber may be formed in square shape. This configuration provides the following advantages. In the case that ink as a liquid is supplied from each of the first, the third and the fourth liquid chambers to corresponding one of the first, the third and the fourth liquid introducing parts, the liquid chamber in rectangular shape causes a difference between the distance from the longer side end of the liquid chamber to the liquid introducing part and the distance from the shorter side end of the liquid chamber to the liquid introducing part. This results in a difference in ink supply efficiency, which is increased with an increase in ratio of the longer side to the shorter side. Forming the liquid chamber in square shape, however, causes no significant difference between the above distances. This configuration accordingly allows for downsizing of the entire liquid supply unit and additionally enhances the supply efficiency of ink contained in the first, the third or the fourth liquid chamber. Forming the liquid chamber in square shape also increases the volume efficiency of the liquid chamber and is thus advantageous for further downsizing of the entire liquid supply unit.

All the plurality of components included in the aspect of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention may be implemented by any of various other aspects: for example, a liquid ejection device configured to receive supply of a liquid from the liquid supply unit and a system including the liquid supply unit and the liquid ejection device.

DESCRIPTION OF EMBODIMENTS

Some aspects of the invention are described below in the following sequence:

A. Embodiment

B. Modifications

A. Embodiment

A-1. Configuration of Liquid Ejection System 1

Figure 1:
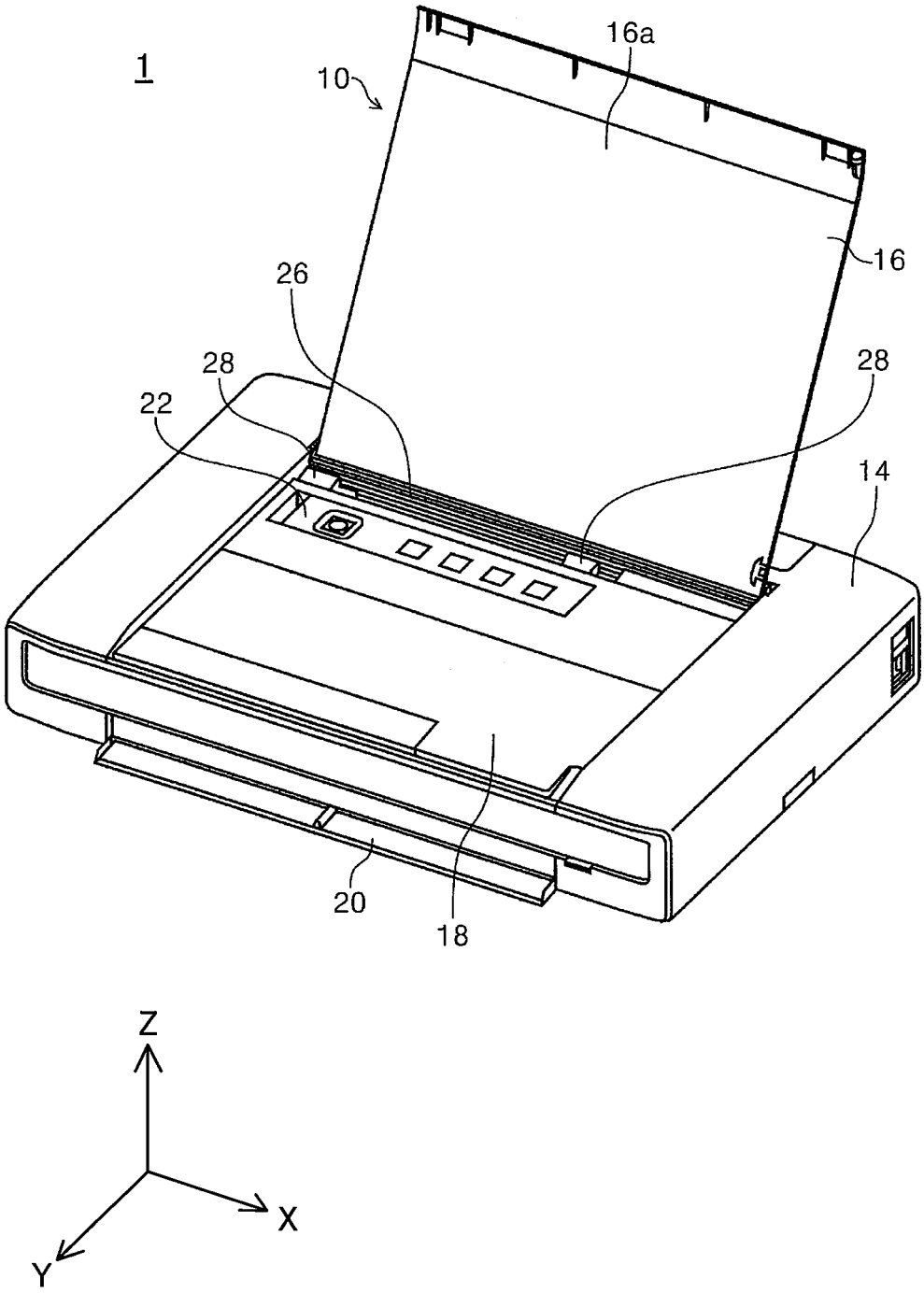
FIG. 1 is a perspective view illustrating the general configuration of a liquid ejection system.
Figure 2:
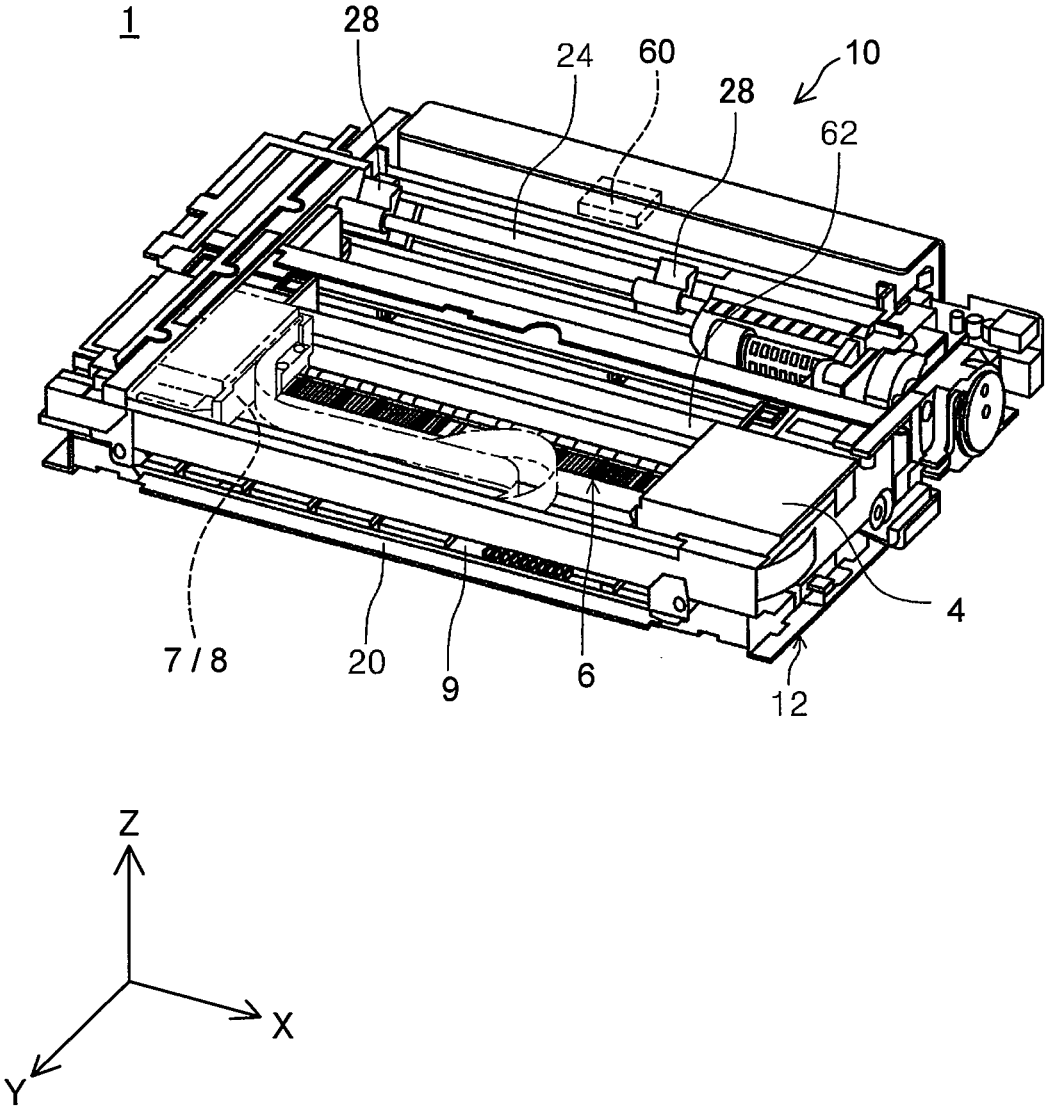
FIG. 2 is a perspective view schematically illustrating the internal configuration of the liquid ejection system.

FIG. 1 is a perspective view illustrating the general configuration of a liquid ejection system 1, and FIG. 2 is a perspective view schematically illustrating the internal configuration of the liquid ejection system 1. XYZ axes orthogonal to one another are shown in FIGS. 1 and 2. The X axis denotes an axis along a direction in which a carriage 8 described later moves back and force and is more specifically an axis along a main scan direction of printing accompanied with the back and forth motion of the carriage 8. The Y axis denotes an axis along a feed path direction of paper sheets in the liquid ejection system 1 placed on a horizontal plane such as desk and is more specifically an axis along a sub scan direction of printing accompanied with the back and forth motion of the carriage 8. The Z axis denotes an axis along the top-bottom direction of the liquid ejection system 1 placed on the horizontal plane such as desk. In other illustrations subsequent to FIG. 2, the XYZ axes are shown as needed. The XYZ axes in FIGS. 1 and 2 correspond to the XYZ axes in the other illustrations. The liquid ejection system 1 includes a printer 10 as a liquid ejection device and a cartridge 4. As shown in FIG. 2, in the liquid ejection system 1 of this embodiment, the cartridge 4 is detachably mounted to a cartridge attachment structure 7 of the printer 10. The cartridge attachment structure 7 includes ejection heads for ink ejection (not shown) and is generally integrated with the carriage 8. The cartridge 4 has the inside divided into four liquid containing parts which respectively contain four different color inks, black, yellow, magenta and cyan. The structure of the cartridge 4 will be described later.

The number and the type of the cartridges mounted to the cartridge attachment structure 7 are, however, not limited to the configuration of this embodiment. For example, a cartridge containing another combination of four color inks (including, for example, light magenta and light cyan) but the combination of black, cyan, magenta and yellow color inks may be provided separately and may be used in combination with the cartridge 4 containing black ink.

The printer 10 is an inkjet printer. As shown in FIG. 1, the printer 10 includes a housing 14, a paper feeding unit cover 16, a recording unit protective cover 18, a paper output unit cover 20 and an operation unit 22. As shown in FIG. 2, the printer 10 has a device body 12.

As shown in FIG. 1, the housing 14 is arranged to surround the periphery of the device body 12 and forms the appearance of the printer 10. The paper feeding unit cover 16 is provided on an upper surface of the printer 10. The paper feeding unit cover 16 is placed on an upper surface of the housing 14 to be rotatable. The paper feeding unit cover 16 is movable between an open position relative to the housing 14 (as shown in FIG. 1) and a closed position (not shown). When the paper feeding unit cover 16 is at the closed position relative to the housing 14, the paper feeding unit cover 16, in combination with the upper surface of the housing 14, forms the upper surface of the printer 10.

When the paper feeding unit cover 16 is at the open position relative to the housing 14, the paper feeding unit cover 16 is inclined relative to a rear surface side (−Y-direction side) of the printer 10. In this state, a rear surface of the paper feeding unit cover 16 serves as a mounting surface **16*a* on which paper sheets are placed. When the paper feeding unit cover 16 is at the open position relative to the housing 14, a paper slot 26 of a paper feeding unit 24 included in the device body 12 as described later is open up in the printer 10. This accordingly enables the paper feeding unit 24 to feed the paper sheets placed on the mounting surface 16*a* to a paper feed path. The paper feed path denotes a paper moving path in the course of printing. The paper slot 26 has a pair of paper guides 28. The pair of paper guides 28 are arranged to adjust the interval in the width direction (X-axis direction) of the printer 10**. The pair of paper guides 28 serve to fasten both ends of a paper sheet in the width direction and specify the position of the paper sheet in the width direction.

When the paper feeding unit cover 16 is at the open position relative to the housing 14, the recording unit protective cover 18 and the operation unit 22 are exposed to be accessible on the upper surface of the printer 10. The recording unit protective cover 18 is movable between an open position relative to the housing 14 (not shown) and a closed position (as shown in FIG. 1). When the recording unit protective cover 18 is at the open position relative to the housing 14, a recording unit 6 provided in the device body 12 is made accessible for the user.

The operation unit 22 is provided with a power button and print settings buttons for operating the printer 10. When the paper feeding unit cover 16 is at the open position relative to the housing 14, the operation unit 22 is made accessible for the user and allows the user to operate the printer 10.

Additionally, the paper output unit cover 20 is provided on a front surface of the housing 14. The paper output unit cover 20 is placed on the front surface of the housing 14 to be rotatable. The paper output unit cover 20 is movable between an open position relative to the housing 14 (as shown in FIG. 1) and a closed position (not shown). When the paper output unit cover 20 is at the open position relative to the housing 14, a paper sheet after recording discharged from a paper output unit 9 of the device body 12 is guided, by the paper output unit cover 20, toward the front side of the printer 10.

As illustrated in FIG. 2, the device body 12 includes the paper feeding unit 24, the recording unit 6, the paper output unit 9 and a controller 60.

The controller 60 is electrically connected with the paper feeding unit 24, the recording unit 6 and the paper output unit 9 and controls the operations of the respective units in response to instructions input from the operation unit 22. The controller 60 also controls the motion of the carriage 8 (motion in the X-axis direction: main scan drive) and the rotation of a feed roller shaft (sub-scan drive) via drive motors (not shown). The carriage 8 has the cartridge attachment structure 7 incorporated in its bottom. The controller 60 also transmits signals to and from circuit substrates included in the cartridge 4.

Figure 3:
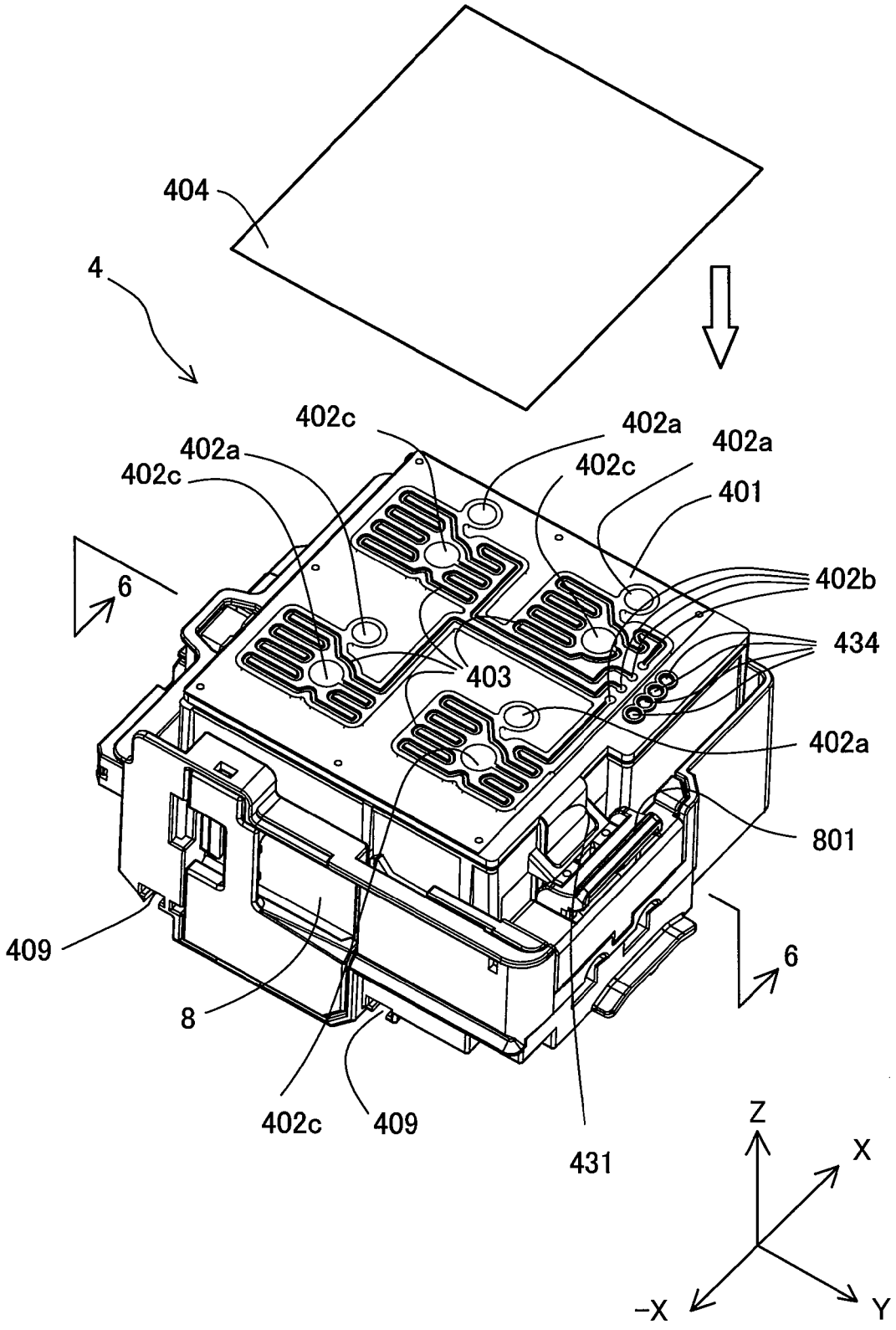
FIG. 3 is a perspective view schematically illustrating the appearance of a carriage in the cartridge attachment state.
Figure 4:
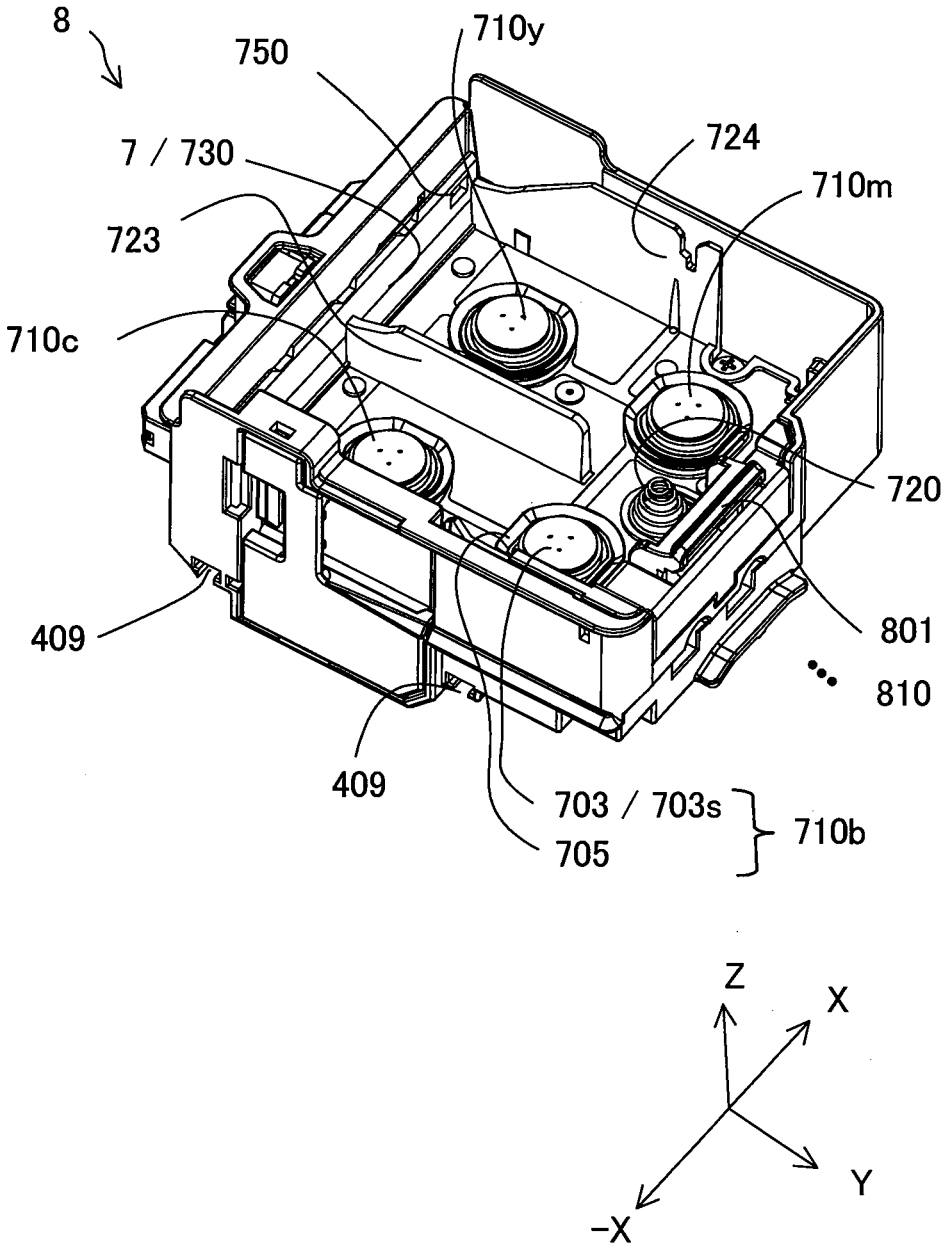
FIG. 4 is a schematic perspective view illustrating the carriage in the non-cartridge attachment state.

The device body 12 also includes a carriage guide rail 62 and a carriage driving unit (not shown) to make the carriage 8 movable along the carriage guide rail 62. The carriage guide rail 62 is extended in the X-axis direction, i.e., the width direction of the device body 12 and is placed in a bearing element 409 (as shown in FIGS. 3 and 4) provided on the bottom side of the carriage 8 to support the carriage 8.

The carriage 8 having the cartridge attachment structure 7 mounted thereon is arranged to move back and forth in the width direction of the device body 12 (X-axis direction, main scan direction) by the carriage driving unit (not shown). The back and forth motion of the carriage 8 in the width direction of the device body 12 causes the cartridge attachment structure 7 to move back and forth in the width direction of the device body 12. The cartridge 4 is accordingly moved in the width direction of the device body 12 (X-axis direction) by the carriage 8. The type of the printer 10 having the ejection heads and the cartridge 4 conveyed by the carriage 8 like this embodiment is called "on-carriage type". In another application, a stationary cartridge attachment structure 7 may be provided at a different position from the carriage 8 to supply the inks from the cartridge 4 attached to the cartridge attachment structure 7 to the ejection heads of the carriage 8 via flexible tubes. This type of printer is called "off-carriage type". In this application, the cartridge 4 is not limited to the detachable cartridge but may be a stationary ink tank. The ink tank may be configured to have an ink filler port through which ink is injectable from outside.

In the use state of the liquid ejection system 1, the X axis denotes an axis along the main scan direction (left-right direction) in which the carriage 8 moves back and forth; the Y axis denotes an axis along the sub-scan direction (front-back direction) in which paper sheets are fed; and the Z axis denotes an axis along the vertical direction (top-bottom direction). Upward in the vertical direction is +Z direction, and downward in the vertical direction is −Z direction. The use state of the liquid ejection system 1 denotes the state of the liquid ejection system 1 placed on a horizontal plane. According to this embodiment, the horizontal plane is a plane parallel to the X axis and the Y axis (XY plane).

A-2. Cartridge Attachment State and Carriage Structure

Figure 5:
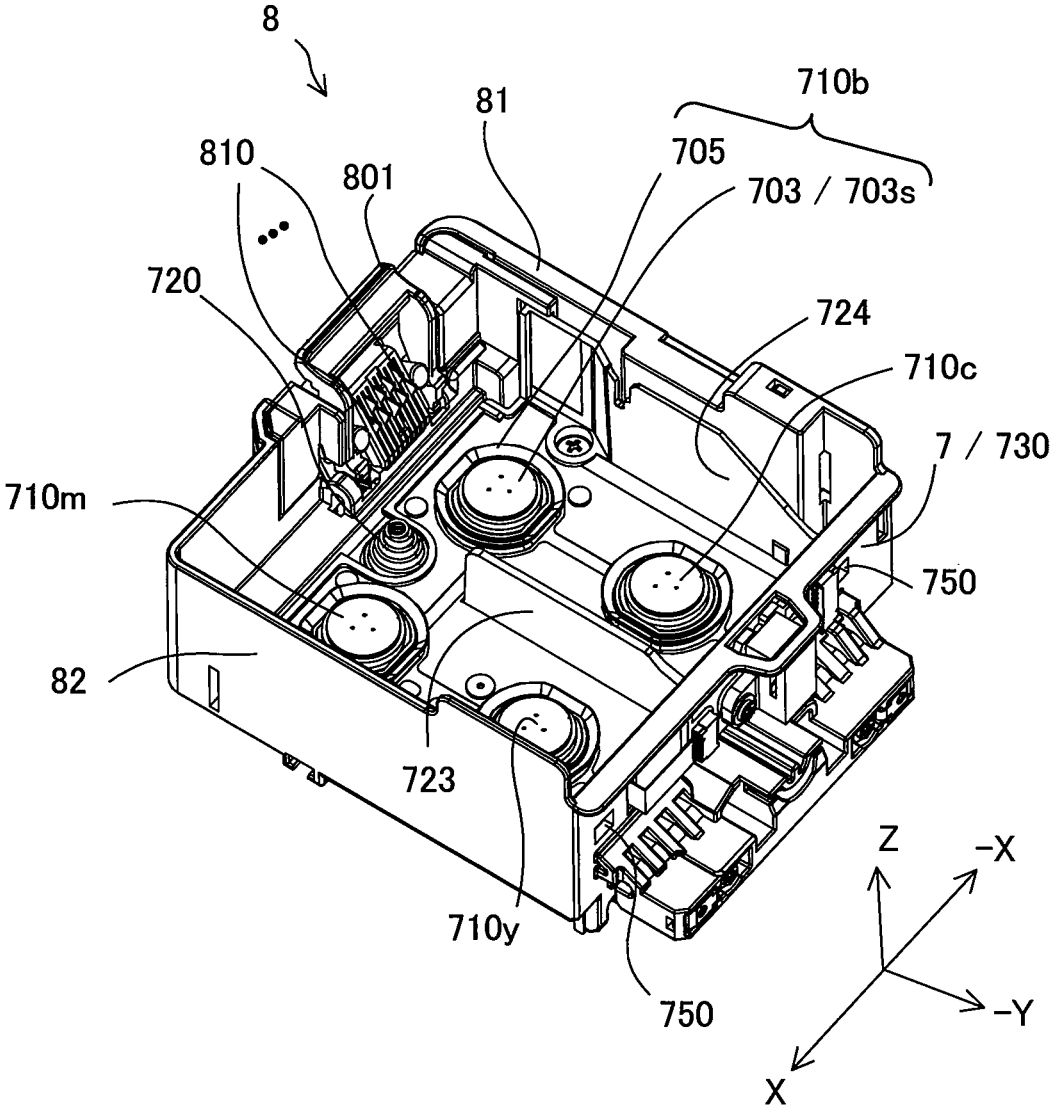
FIG. 5 is a schematic perspective view illustrating the carriage in the non-cartridge attachment state, viewed in a different direction from that of FIG. 4.
Figure 6:
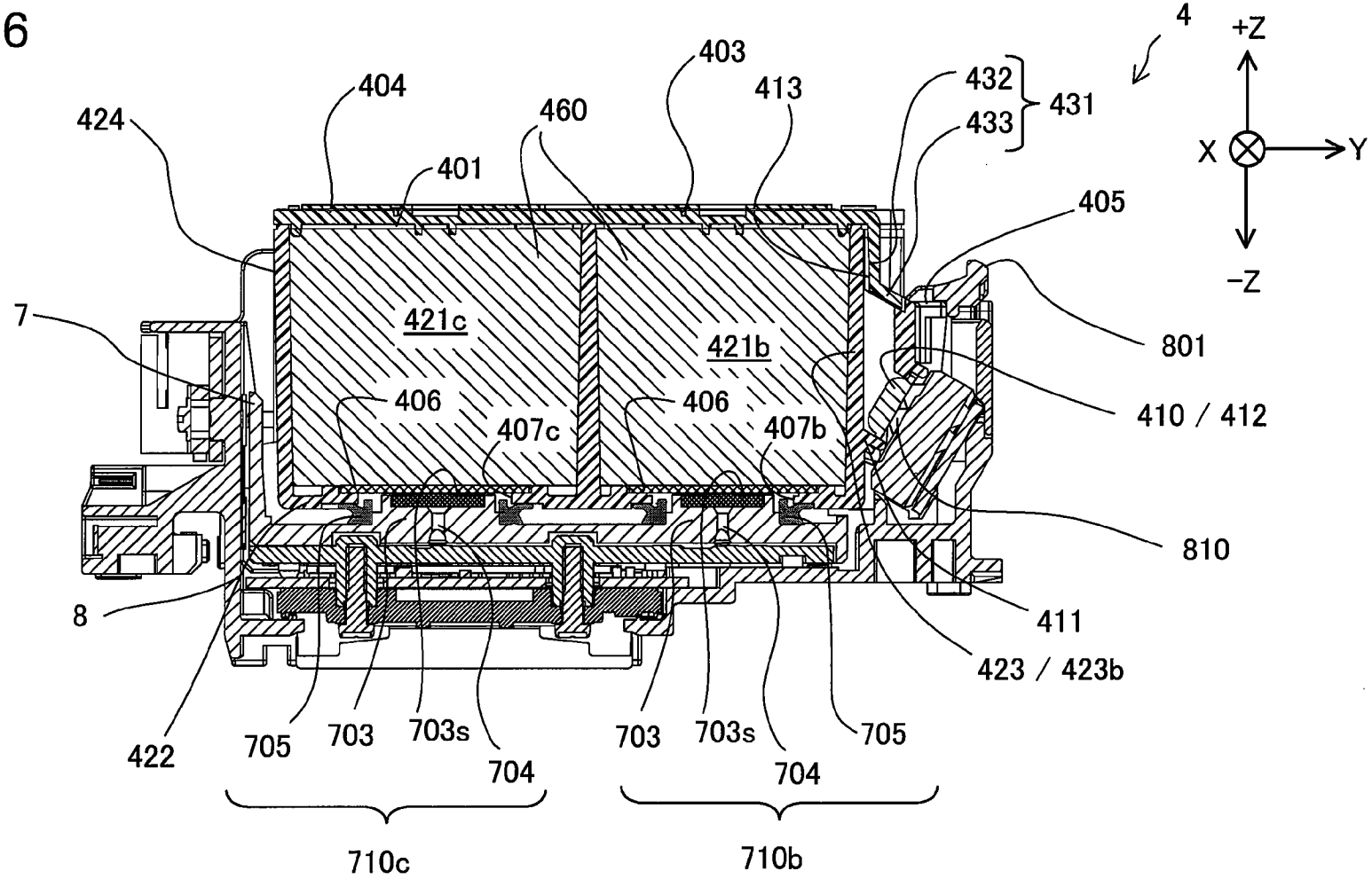
FIG. 6 is a schematic cross sectional view taken on a line 6-6 in FIG. 3.

FIG. 3 is a perspective view schematically illustrating the appearance of the carriage 8 in the cartridge attachment state. FIG. 4 is a schematic perspective view illustrating the carriage 8 in the non-cartridge attachment state. FIG. 5 is a schematic perspective view illustrating the carriage 8 in the non-cartridge attachment state, viewed in a different direction from that of FIG. 4. FIG. 6 is a schematic cross sectional view taken on a line 6-6 in FIG. 3. The cartridge attachment structure 7 is mounted on the bottom of the carriage 8 and is thus omitted from the illustration of FIG. 3.

As shown in FIG. 3, the cartridge 4 includes a cover 401 and has through holes 402*a*, 402*b* and 402*c* formed to pass through the cover 401, four air grooves 403 arranged in a serpentine shape from the respective through holes 402*c* to the corresponding through holes 402*b*, and air communication holes 434 connected with the respective air grooves 403 on the rear surface of the cover 401. In the manufacturing process of the cartridge 4, the through holes 402*a* serve as evacuation holes to suck the air from inside of the cartridge 4 and keep the inside of the cartridge 4 in the reduced pressure. After manufacture of the cartridge 4, the through holes 402*a* are sealed and closed by a seal member 404. In the manufacturing process of the cartridge 4, the through holes 402*c* serve as ink injection holes through which inks are injected into inside of the cartridge 4. After manufacture of the cartridge 4, the through holes 402*c* are used to supply the air to liquid retaining members 460 described later via the air grooves 403, the through holes 402*b* and the air communication holes 434. As explained above, the cartridge 4 is configured to contain the four different color inks, black, yellow, magenta and cyan in respective liquid containing parts for the respective color inks described later. The through holes 402*a* and 402*c* and the air grooves 403 are provided at positions corresponding to the respective liquid containing parts. The through holes 402*b* are provided at respective ends of the air grooves 403 to be aligned in the X-axis direction. The air communication holes 434 are provided to be arrayed in the Y-axis direction with the through holes 402*b* aligned in the X-axis direction. The cartridge 4 has the seal member 404 to be joined with the upper surface of the cover 401 and thereby cover the openings of the above through holes and air grooves.

The cartridge 4 joined with the seal member 404 is attached to the carriage 8 via the cartridge attachment structure 7 placed on the bottom of the carriage 8, as shown in FIGS. 4 and 5. In the description below, attachment of the cartridge 4 to the carriage 8 is regarded as synonymous with attachment of the cartridge 4 to the cartridge attachment structure 7. In the attachment state of the cartridge 4, an engagement portion 405 described later as an attachment/detachment mechanism included in the cartridge 4 is engaged with a cartridge engagement arm 801 of the carriage 8. The user may apply an external force to the cartridge engagement arm 801 to rotate and displace the cartridge engagement arm 801 and release engagement of the cartridge 4 with the carriage 8. The user can then detach the cartridge 4 from the carriage 8.

As shown in FIGS. 4 and 5, the carriage 8 has the cartridge attachment structure 7. The cartridge attachment structure 7 includes a liquid introducing part 710*b* for black ink, a liquid introducing part 710*y* for yellow ink, a liquid introducing part 710*m* for magenta ink, a liquid introducing part 710*c* for cyan ink, and a cone-shaped coil spring 720. The cartridge 4 is mountable on this cartridge attachment structure 7. The coil spring 720 is provided on the cartridge engagement arm 801-side. The coil spring 720 is compressed in the cartridge attachment state and is stretched to press up the cartridge 4 in the state of releasing the engagement of the cartridge engagement arm 801. Elastic members 705 are members made of, for example, an elastomer and formed in a ring shape and are mounted on outer wall sections of respective liquid introducing bases 703.

The respective liquid introducing parts 710 for the respective color inks are provided corresponding to the liquid containing parts of the cartridge 4 attached to the cartridge attachment structure 7 and have similar structures. The structure of the liquid introducing part 710*b* is described as an example. The liquid introducing part 710*b* includes a liquid introducing base 703, a metal mesh 703*s* and an elastic member 705. The metal mesh 703*s* is provided as a filter made of a metal having corrosion resistance, such as stainless steel and is placed on an upper end of the liquid introducing base 703 to be in surface contact with a supply port-side liquid retaining member 406 of the cartridge 4 described later (as shown in FIG. 6). Ink retained in the supply port-side liquid retaining member 406 passes through the metal mesh 703*s* and is supplied to the non-illustrated ejection head provided on the bottom surface of the carriage 8. The supply port-side liquid retaining member 406 is accordingly connected with the liquid introducing part 710 through the surface contact with the metal mesh 703*s*. The relationship between the respective liquid introducing parts 710 and the cartridge 4 will be described later.

The cartridge 4 has a circuit substrate 410 on a +Y-direction end, as shown in FIG. 6. This circuit substrate 410 is fixed to a substrate mounting structure 411 inclined with respect to a first end wall 423. Fixation of the circuit substrate 410 to the substrate mounting structure 411 and the location of the circuit substrate 410 will be described later. The circuit substrate 410 provided on the cartridge 4 has terminals 412 described later. In the state of attachment of the cartridge 4 to the carriage 8, contact portions of the terminals 412 are electrically in contact with electrodes of an electrode assembly 810 provided on the carriage 8. The cartridge 4 has the engagement portion 405 provided on an end of the substrate mounting structure 411 in the Y-axis direction. The engagement portion 405 is engaged with the cartridge engagement arm 801 of the carriage 8 in the state of attachment of the cartridge 4 to the carriage 8. The carriage 8 including the electrode assembly 810 may be called carriage unit.

FIG. 6 illustrates the state of attachment of the cartridge 4 to the carriage 8. The cartridge 4 has a supply port-side liquid retaining member 406 and a liquid retaining member 460 which serve to absorb and retain the liquid and are provided in each recess as described later. The supply port-side liquid retaining member 406 and the liquid retaining member 460 are arranged to be in contact with each other. The liquid introducing part 710*b* provided on the bottom surface of the cartridge attachment structure 7 is in surface contact with the supply port-side liquid retaining member 406 via the metal mesh 703*s* attached to a ring-shaped end of the liquid introducing base 703. The supply port-side liquid retaining member 406 is lifted up in the +Z direction by the liquid introducing base 703 to press the liquid retaining member 460. This causes the liquid contained in the liquid retaining member 460, i.e., black ink, to be supplied to the ejection head of the cartridge attachment structure 7 through the supply port-side liquid retaining member 406, the metal mesh 703*s* of the liquid introducing base 703 of the liquid introducing part 710*b* and a suction hole 704. Accordingly, the liquid introducing part 710*b* receives a liquid (black ink) introduced from the cartridge 4, and the carriage 8 causes the liquid (black ink) introduced to the liquid introducing part 710*b* to be ejected from the ejection head. The same applies to the liquid introducing parts 710*c*, 710*m* and 710*y* shown in FIGS. 4 to 6.

Figure 9:
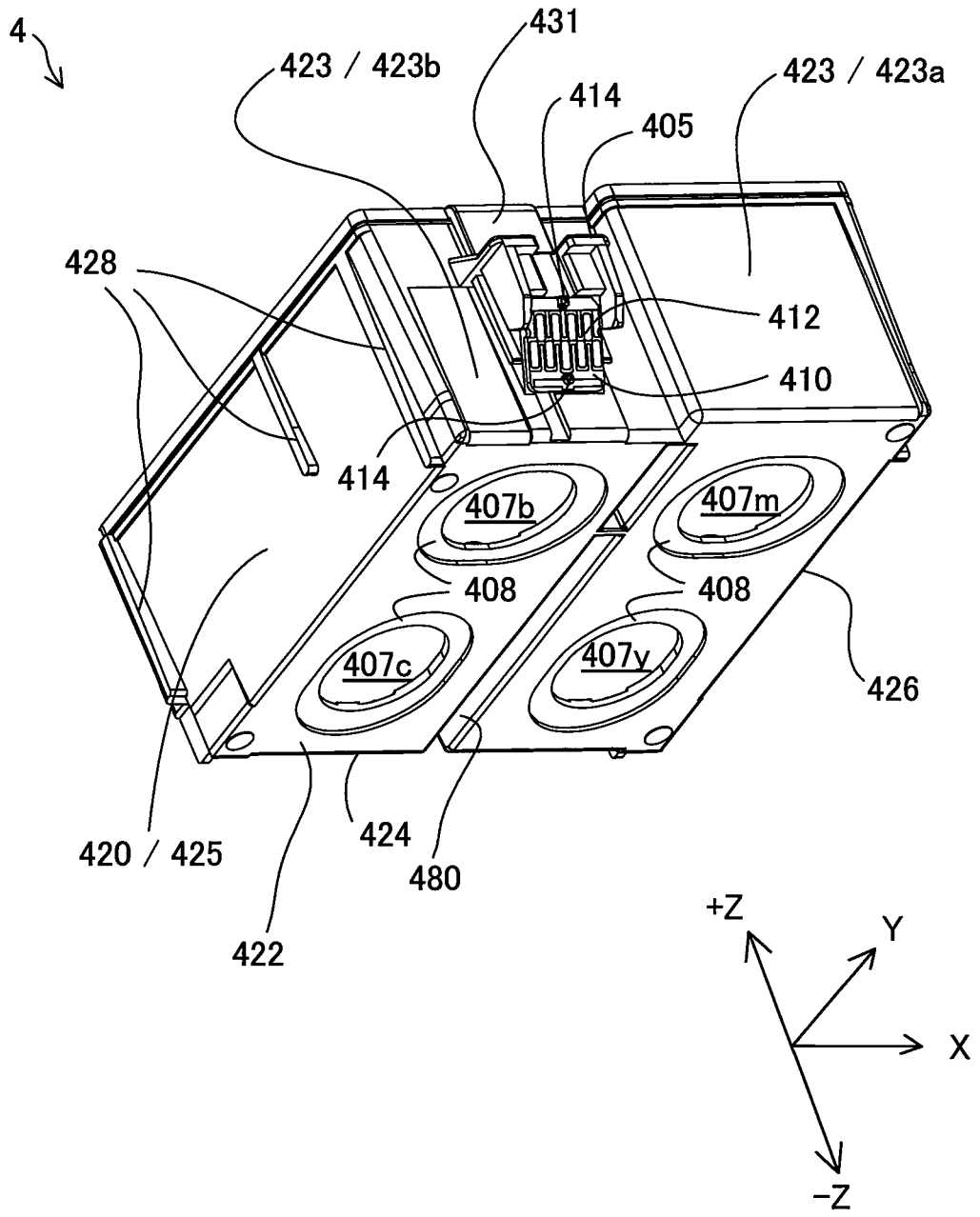
FIG. 9 is a perspective view illustrating the appearance of the cartridge, viewed from the bottom surface side.

The cartridge 4 has liquid supply ports 407*b*, 407*c*, 407*m* and 407*y* respectively covered by the corresponding supply port-side liquid retaining members 406. The cartridge attachment structure 7 has the liquid-tight elastic members 705 at the foot of the respective liquid introducing bases 703. The elastic members 705 are in contact with peripheral concaved areas 408 (as shown in FIG. 9) formed around the peripheries of the respective liquid supply ports 407*b*, 407*c*, 407*m* and 407*y* to seal the liquid supply ports 407*b*, 407*c*, 407*m* and 407*y* and prevent leakage of inks from the liquid supply ports 407*b*, 407*c*, 407*m* and 407*y* in the cartridge attachment state. In the cartridge attachment state, each of the liquid supply ports 407*b*, 407*c*, 407*m* and 407*y* is connected with corresponding one of the liquid introducing parts 710*b*, 710*c*, 710*m* and 710*y* described above to supply the ink to the corresponding liquid introducing part. The structure of attaching the cartridge 4 to the cartridge attachment structure 7 of the carriage 8 will be described later.

The cartridge attachment structure is mounted on the bottom of the carriage 8. As shown in FIGS. 4 and 5, the cartridge attachment structure 7 includes a guide projection 723 and sidewall-side projections 724. The sidewall-side projections 724 are placed inside of carriage side walls 81 and 82 on both sides in the X-axis direction of the carriage 8 to face each other as shown in FIGS. 4 and 5. The sidewall-side projections 724 are extended from an end wall 730 of the cartridge attachment structure 7 in the +Y direction toward the cartridge engagement arm 801.

The guide projection 723 is extended from the end wall 730 in the +Y direction between the liquid introducing part 710*y* and the liquid introducing part 710*c* toward the coil spring 720. In other words, the guide projection 723 is placed between the liquid introducing part 710*y* and the liquid introducing part 710*c* which are adjacent to each other in the X-axis direction. The guide projection 723 has a lower projection height from the bottom surface of the cartridge attachment structure 7 in an area near to the end wall 730 than the projection height between the liquid introducing part 710*y* and the liquid introducing part 710*c*. The cartridge 4 enters between the sidewall-side projections 724 placed inside of the respective carriage side walls 81 and 82 and arranged to face each other and is attached to the cartridge attachment structure 7 of the carriage 8. The guide projection 723 enters a bottomed groove 480 described later (as shown in FIG. 9) of the attached cartridge 4. The cartridge attachment structure 7 has engagement holes 750 formed in the end wall 730. The two engagement holes 750 are provided, and engagement projections 424*t* described later are fit in these engagement holes 750 in the course of attachment of the cartridge. The attachment of the cartridge 4 and the relationship between the guide projection 723 and the cartridge 4 will be described later.

A-3. Structure of Cartridge 4

Figure 7:
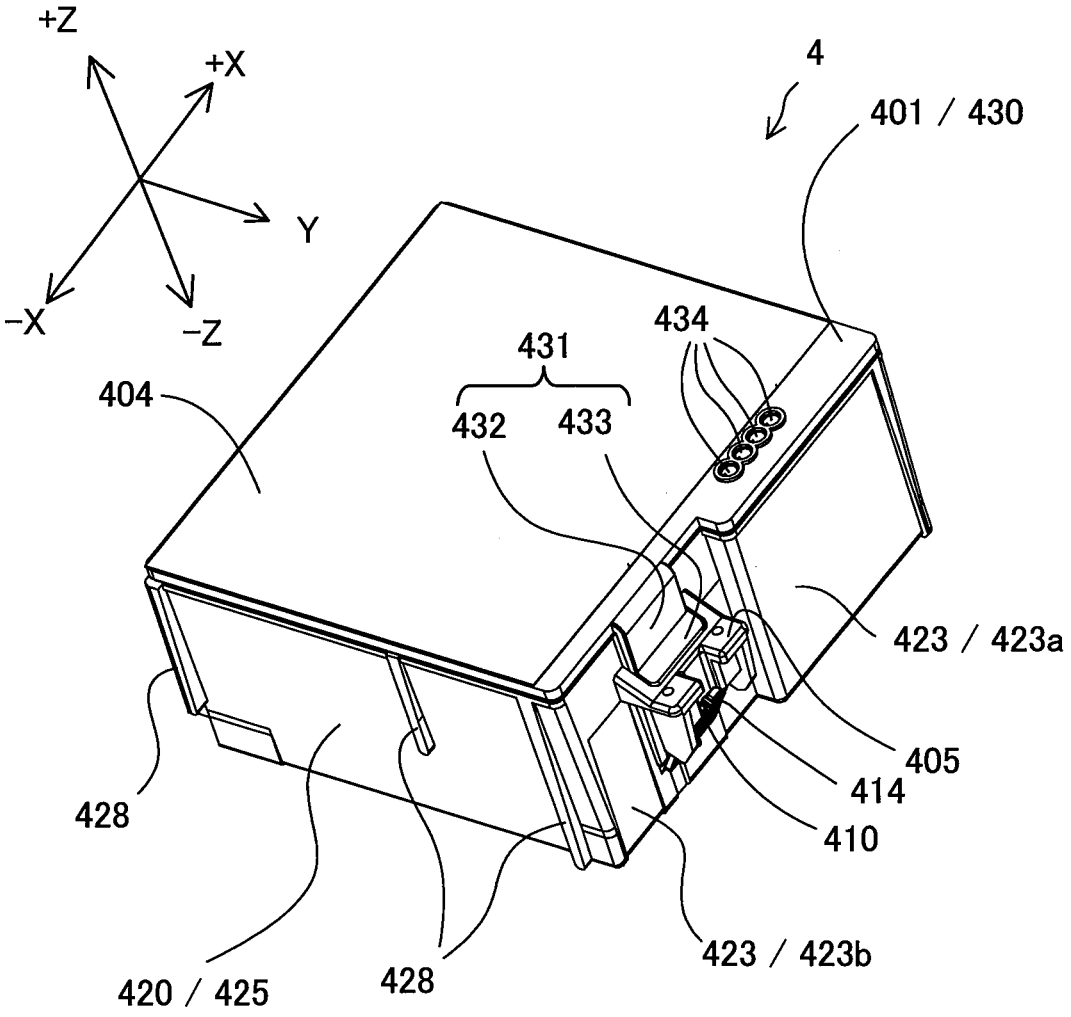
FIG. 7 is a perspective view illustrating the appearance of a cartridge.
Figure 8:
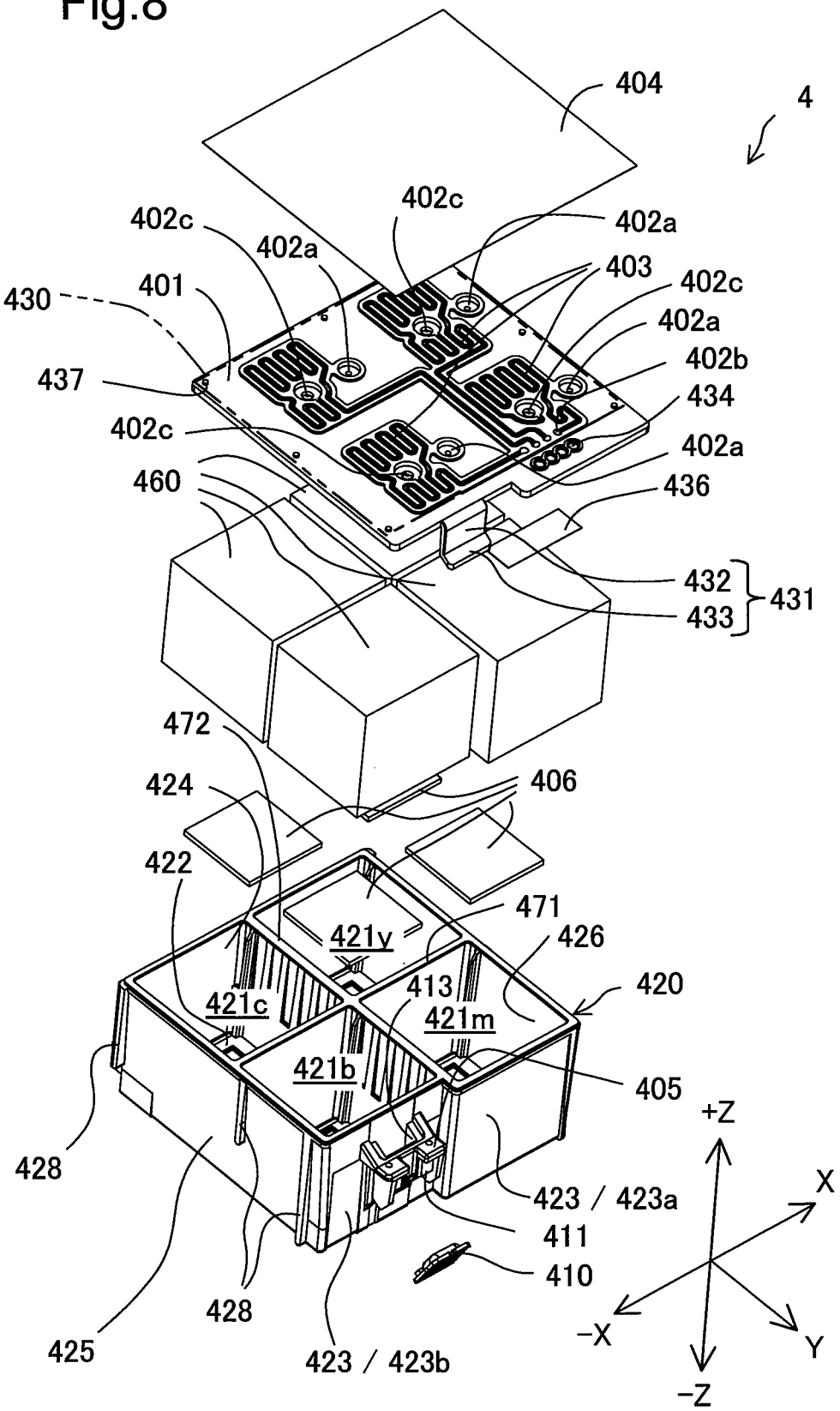
FIG. 8 is an exploded perspective view illustrating the cartridge.
Figure 10:
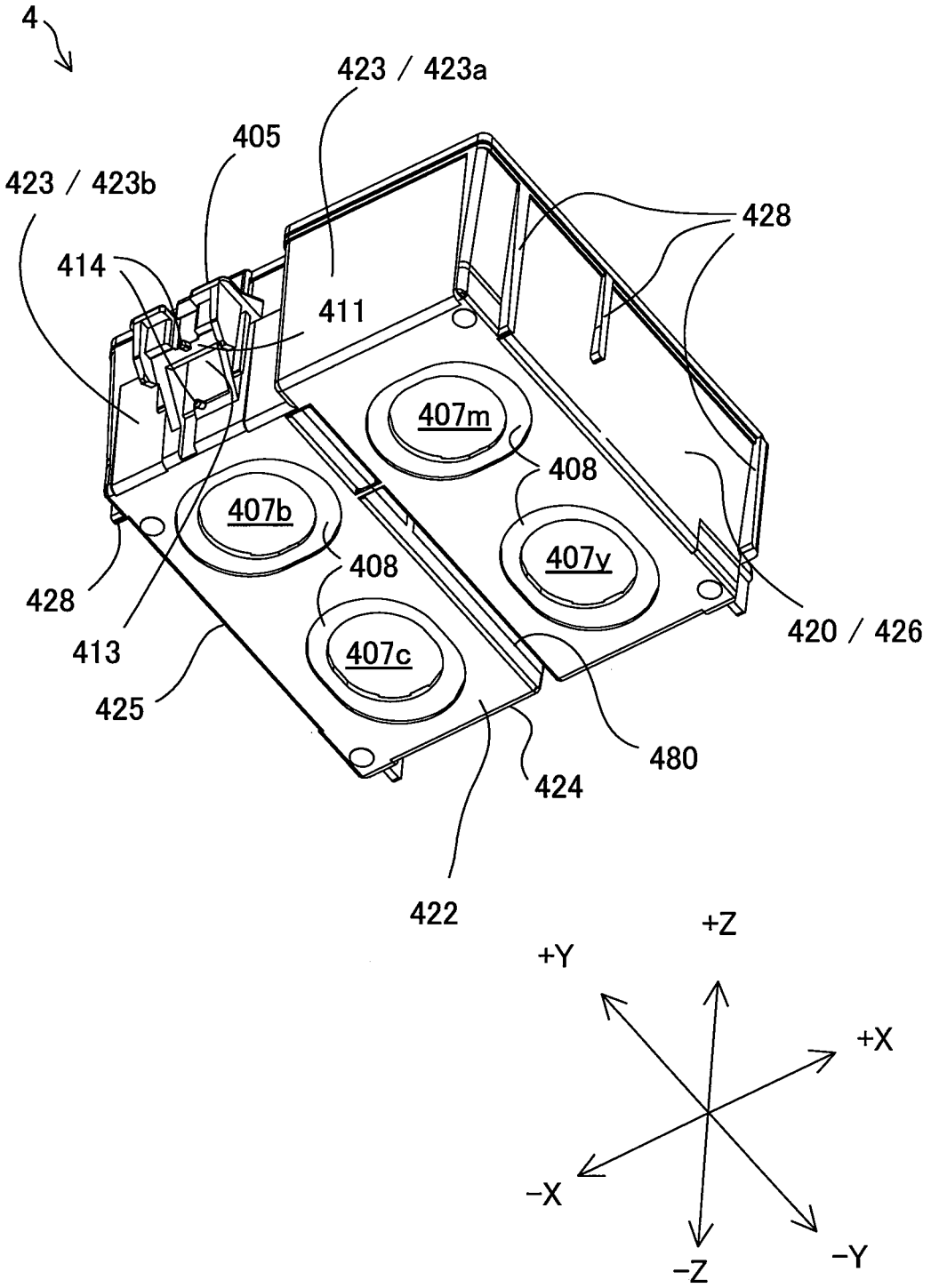
FIG. 10 is a perspective view illustrating the appearance of the cartridge without a circuit substrate circuit substrate mounted thereto, viewed from the bottom surface side.
Figure 11:
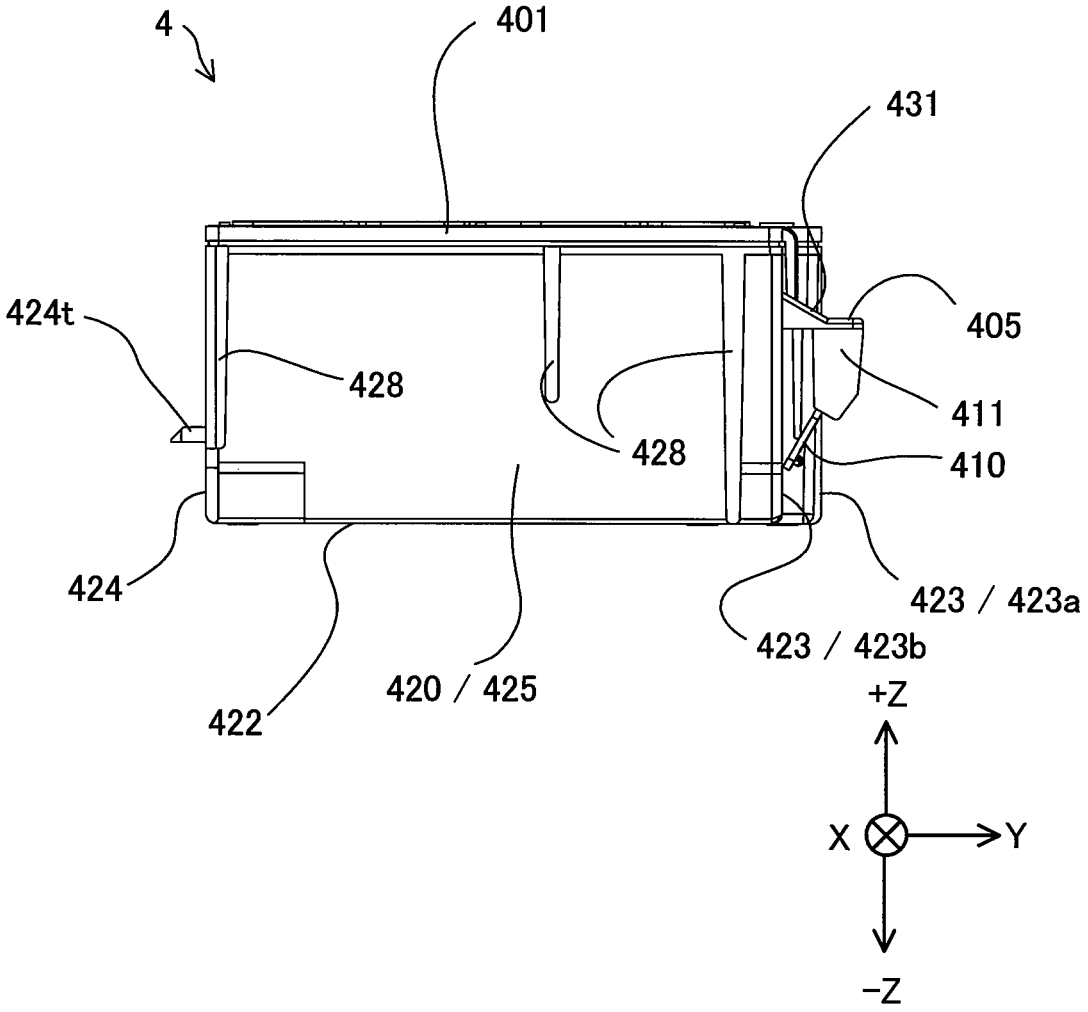
FIG. 11 is a side view illustrating the cartridge, viewed in the +X direction.
Figure 12:
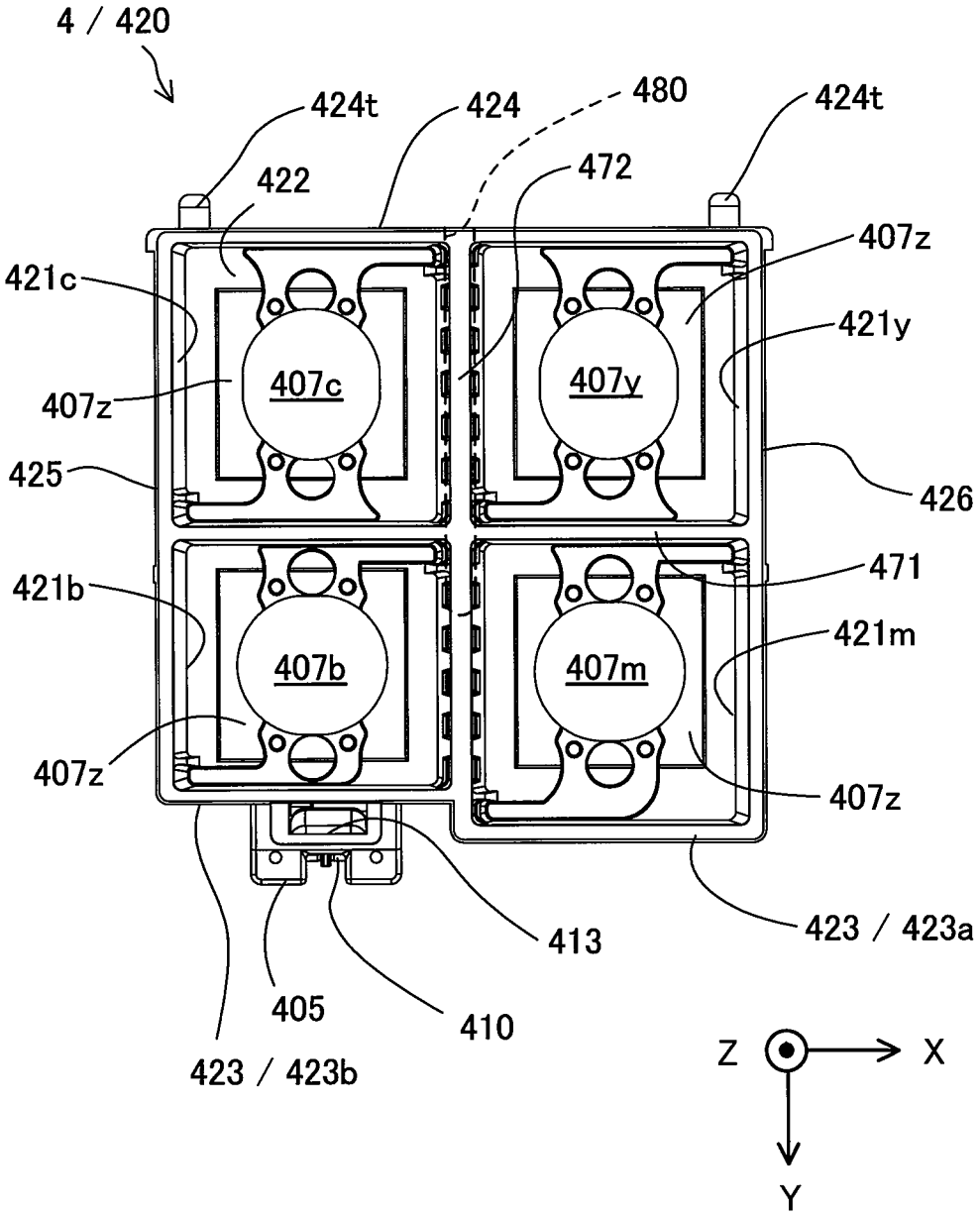
FIG. 12 is a plan view illustrating the cartridge with removal of a cover, viewed in the −Z direction.
Figure 13:
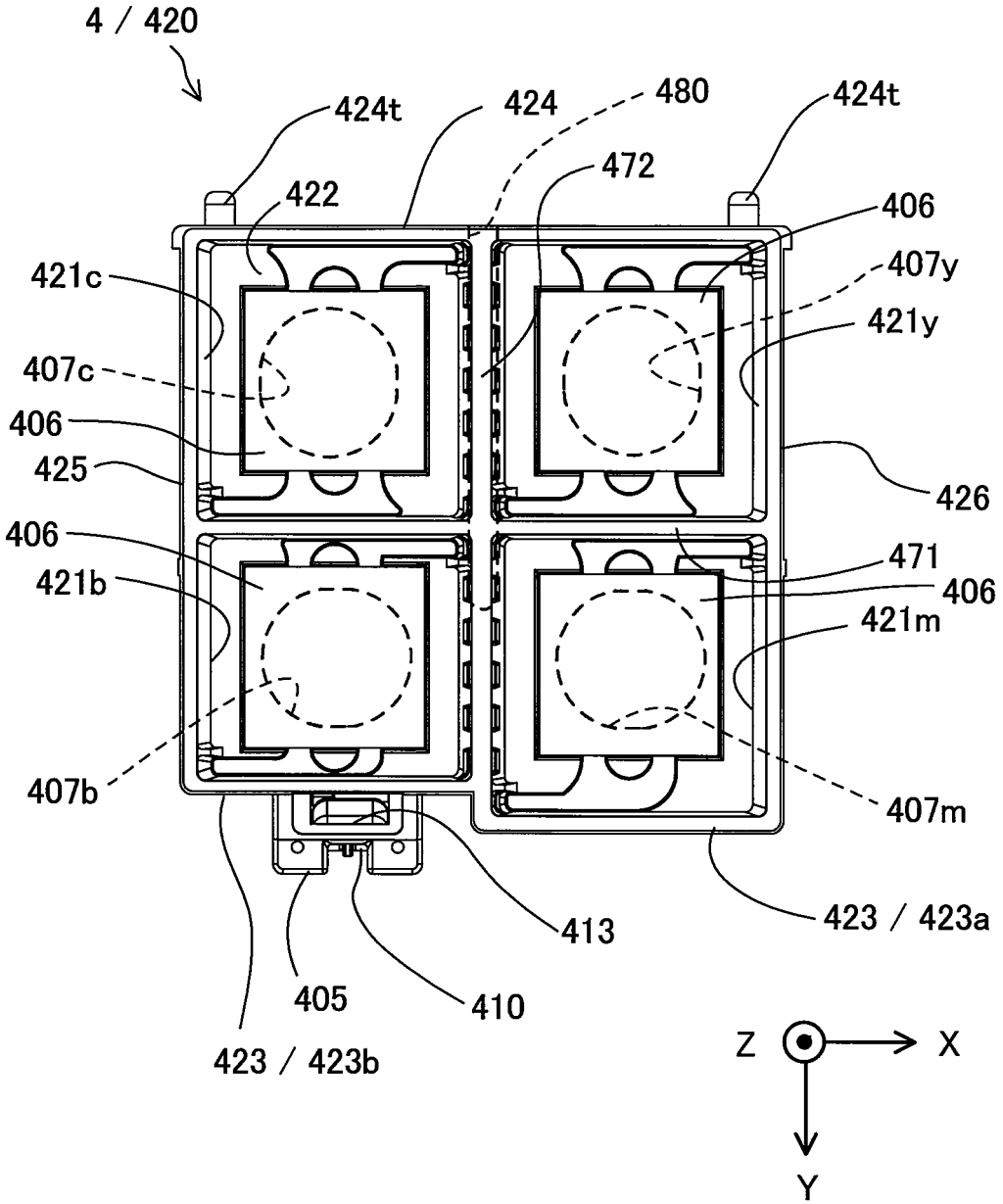
FIG. 13 is a plan view illustrating the cartridge with the supply port-side liquid retaining members placed therein, viewed in the −Z direction.

FIG. 7 is a perspective view illustrating the appearance of a cartridge 4. FIG. 8 is an exploded perspective view illustrating the cartridge 4. FIG. 9 is a perspective view illustrating the appearance of the cartridge 4, viewed from the bottom surface side. FIG. 10 is a perspective view illustrating the appearance of the cartridge 4 without the circuit substrate 410 mounted thereto, viewed from the bottom surface side. FIG. 11 is a side view illustrating the cartridge 4, viewed in the +X direction. FIG. 12 is a plan view illustrating the cartridge 4 with removal of the cover 401, viewed in the −Z direction. FIG. 13 is a plan view illustrating the cartridge 4 with the supply port-side liquid retaining members 406 placed therein, viewed in the −Z direction. As illustrated, the cartridge 4 has a casing 420, the cover 401 and the circuit substrate 410. The cover 401 is fixed to the casing 420 to cover recesses 421*b*, 421*y*, 421*c* and 421*m* for the respective color inks of the casing 420 (as shown in FIGS. 8 and 12). The cartridge 4 also has the supply port-side liquid retaining members 406 for the respective color inks, the liquid retaining members 460 for the respective color inks, a cover backside seal member 436 and the seal member 404. The casing 420 and the cover 401 are molded products of a synthetic resin such as polyethylene or polypropylene and are formed by any adequate molding technique such as injection molding.

As shown in FIGS. 8 to 12, the casing 420 includes a bottom wall 422, a first end wall 423, a second end wall 424, a first side wall 425, a second side wall 426, a partition wall 471 placed between the first side wall 425 and the second side wall 426, and a partition wall 472 arranged to intersect with the partition wall 471 and placed between the first end wall 423 and the second end wall 424. These partition walls of the casing 420 form the recesses 421*b*, 421*y*, 421*m* and 421*c* corresponding to the respective color inks, black, yellow, cyan magenta and cyan. The outer wall surfaces of the first side wall 425 and the second side wall 426 are reinforced by ribs 428. The bottom wall 422 forms the bottom surface of the casing 420 and has the liquid supply ports 407*b*, 407*y*, 407*m* and 407*c* for the respective color inks, black, yellow, cyan magenta and cyan and the peripheral concaved areas 408. The bottom wall 422 is arranged to be opposed to the cover 401. The first end wall 423 rises from the bottom wall 422 and is arranged to intersect with a cover member 430 of the cover 401. In the plan view of the bottom wall 422 in the direction toward the bottom wall 422 (hereinafter this direction is called first direction), the first end wall 423 includes a first wall surface portion 423*a* and a second wall surface portion 423*b* adjacent to the first wall surface portion 423*a* in the X-axis direction. The distance between the second end wall 424 and the first wall surface portion 423*a* of the first end wall 423 in the Y-axis direction is set to be greater than the distance between the second end wall 424 and the second wall surface portion 423*b* in the Y-axis direction. The second end wall 424 rises from the bottom wall 422 and is arranged to intersect with the cover 401 and to be opposed to the first end wall 423. The first side wall 425 rises from the bottom wall 422 between one edge (−X-direction edge in FIG. 8) of the first end wall 423 and one edge (−X-direction edge in FIG. 8) of the second end wall 424 and is arranged to intersect with the cover 401. The second side wall 426 rises from the bottom wall 422 between the other edge (+X-direction edge in FIG. 8) of the first end wall 423 and the other edge (+X-direction edge in FIG. 8) of the second end wall 424 and is arranged to intersect with the cover 401 and to be opposed to the first side wall 425.

The wall configuration and the above respective recesses may all be expressed as follows. The casing 420 includes: the bottom wall 422 having the liquid supply ports 407*b*, 407*y*, 407*m* and 407*c* for the respective color inks formed therein and the supply port-side liquid retaining members 406 provided corresponding to the respective liquid supply ports; the cover 401 opposed to the bottom wall 422; the first end wall 423 arranged to intersect with the bottom wall 422 and the cover 401 and to have the first wall surface portion 423*a* and the second wall surface portion 423*b*; the second end wall 424 arranged to intersect with the bottom wall 422 and the cover 401 and to be opposed to the first end wall 423; the first side wall 425 arranged to intersect with the bottom wall 422 and the cover 401; and the second side wall 426 arranged to intersect with the bottom wall 422 and the cover 401 and to be opposed to the first side wall 425. In the plan view of the bottom wall 422 of the casing 420 in the first direction, the recess 421*m* and the recess 421*y* are arrayed in the Y-axis direction between the second end wall 424 and the first wall surface portion 423*a*, and the recess 421*b* and the recess 421*c* are arrayed in the Y-axis direction between the second end wall 424 and the second wall surface portion 423*b*. In the casing 420, the supply port-side liquid retaining members 406 and the liquid retaining members 460 are stacked in this sequence to be placed on the liquid supply ports 407*b*, 407*c*, 407*m* and 407*y* of the recesses 421*b*, 421*c*, 421*m* and 421*y* arranged as described above. As shown in FIG. 13, the supply port-side liquid retaining members 406 are laid to cover the liquid supply ports 407*b*, 407*c*, 407*m* and 407*y* of the above respective recesses, and the liquid retaining members 460 are stacked on the supply port-side liquid retaining members 406.

The cartridge 4 of the embodiment has the first wall surface portion 423*a* and the second wall surface portion 423*b* of the different distances in the Y-axis direction. Accordingly, in the cartridge 4, the length of the recess 421*c* and the length of the liquid retaining member 460 placed therein in a direction from the second end wall 424 toward the first end wall 423 (hereinafter this direction is called second direction) are set to be longer than the length of the recess 421*b* and the length of the liquid retaining member 460 placed therein in the second direction. In the cartridge 4, the capacity of the recess 421*c* and the volume of the liquid retaining member 460 placed therein are set to be greater than the capacity of the recess 421*b* and the volume of the liquid retaining member 460 placed therein. In the plan view of the bottom wall 422 of the cartridge 4 in the first direction, as shown in FIG. 12, the recesses 421*c*, 421*y* and 421*m*, as well as the liquid retaining members 460 placed therein are formed in square shape.

As shown in FIG. 9, the circuit substrate 410 has a plurality of terminals 412 on the substrate surface and is located on the second wall surface portion 423*b* of the first end wall 423 of the casing 420. The substrate mounting structure 411 is formed on the second wall surface portion 423*b* as shown in FIG. 10. The substrate mounting structure 411 is arranged to be inclined with respect to the second wall surface portion 423*b*. The circuit substrate 410 has the rear surface fixed to the substrate mounting structure 411 and is inclined with respect to the second wall surface portion 423*b*. As shown in FIG. 9, the terminals 412 are arrayed zigzag in two lines on the circuit substrate 410. When the cartridge 4 is attached to the carriage 8 as described above, the contact portions of the respective terminals 412 are electrically connected with respective electrodes of the electrode assembly 810 provided on the carriage 8 as shown in FIG. 6. The shape and the arrangement of the terminals 412 are not limited to those of FIG. 9. The terminals 412 may have any configuration which 6 enables their contact portions to be electrically connectable with the electrode assembly 810.

As shown in FIG. 10, the substrate mounting structure 411 is provided on the second wall surface portion 423*b* of the first end wall 423. The engagement element 405 of the substrate mounting structure 411 is accordingly provided on the second wall surface portion 423*b* to be engaged with the cartridge engagement arm 801 of the carriage 8. The substrate mounting structure 411 also has an opening 413 formed on the outer wall surface side of the second wall surface portion 423*b*. The opening 413 is extended in the Z-axis direction along the outer wall surface of the second wall surface portion 423*b* from an upper edge side toward a lower edge side of the second wall surface portion 423*b* (as shown in FIG. 8) and is open on the upper edge side and the lower edge side of the second wall surface portion 423*b*. In the state that the cover 401 is fixed to the casing 420, the opening 413 is closed on the upper edge side of the second wall surface portion 423*b* by an outward extension member 431 of the cover 401 described later as shown in FIG. 9. Projections 414 protruded from the substrate mounting structure 411 are used for fixation of the circuit substrate 410 to the substrate mounting structure 411. As shown in FIG. 9, the projections 414 are thermally caulked in the state that the projections 414 are extended from the circuit substrate 410. This fixes the circuit substrate 410 to the substrate mounting structure 411. The first wall surface portion 423*a* of the first end wall 423 is protruded more than the circuit circuit substrate 410 fixed to the substrate mounting structure 411 in the direction from the second end wall 424 toward the first end wall 423.

As shown in FIG. 8, the cover 401 has the through holes 402*a*, 402*b* and 402*c*, the air grooves 403 formed between the respective through holes 402*c* and the corresponding through holes 402*b*, the air communication holes 434 and seal member receiving elements 437 around the periphery of the cover 401, which are provided for the respective recesses 421*b*, 421*m*, 421*c* and 421*y* described above. The seal member receiving elements 437 are protruded from the upper surface of the cover 401 to substantially the same height as the height of the circumferential walls of the through holes 402*a*, 402*b* and 402*c* and the circumferential wall of the air grooves 403 and serve as joint seat elements of the seal member 404.

The four air communication holes 434 are aligned in the X-axis direction along the outer periphery of the cover member 430 and are formed to pass through the cover 401. The through holes 402*b* for the respective color inks, black, yellow, magenta and cyan are formed to pass through the cover 401 at the respective ends of the air grooves 403 for the respective colors and to be arrayed in the Y-axis direction with the air communication holes 434 aligned in the X-axis direction. The air communication holes 434 and the through holes 402*b* arrayed in the Y-axis direction are connected by air grooves (not shown) on the rear surface side of the cover 401. The cover backside openings of the air grooves and the through holes 402*b* and the cover backside openings of the air communication holes 434 are sealed by the cover backside seal member 436. The recesses 421*b*, 421*m*, 421*c* and 421*y* of the casing 420 closed by the cover 401 are accordingly open to the air through the through holes 402*c*, the air grooves 403 and the air communication holes 434. The through holes 402*a*, 402*b* and 402*c* and the air grooves 403 are sealed on the upper surface side of the cover 401 by the seal member 404. This arrangement of open to the air described above enables ink contained in the porous liquid retaining member 460 placed in each of the recesses 421*b*, 421*m*, 421*c* and 421*y* for the respective color inks of the casing 420 closed by the cover 401 to be supplied to the supply port-side liquid retaining member 406 and the liquid introducing part 710*b*, the liquid introducing part 710*m*, the liquid introducing part 710*c* or the liquid introducing part 710*y* of the carriage 8 via the corresponding liquid supply port (as shown in FIG. 4). More specifically, the liquid supply port 407*b* of the recess 421*b* is connected with the liquid introducing part 710*b* of the carriage 8 to supply the corresponding color ink. Similarly the liquid supply port 407*c* of the recess 421*c*, the liquid supply port 407*y* of the recess 421*y* and the liquid supply port 407*m* of the recess 421*m* are respectively connected with the liquid introducing part 710*c*, the liquid introducing part 710*y* and the liquid introducing part 710*m* to supply the corresponding color inks. In the state that the supply port-side liquid retaining members 406 and the liquid retaining members 460 are placed in the respective recesses as described above, the cover 401 joined with the cover backside seal member 436 and the seal member 404 is welded and fixed to the casing 420 to complete the cartridge 4 shown in FIGS. 6 and 7.

Both the supply port-side liquid retaining member 406 and the liquid retaining member 460 may be made of a porous resin material. The porous resin material herein is not specifically limited but may be any porous resin material having the capacity of retaining the liquid, for example, a foamed material such as polyurethane foam or a fibrous material of bundled polypropylene fibers. The supply port-side liquid retaining member 406 and the liquid retaining member 460 have different characteristics of retaining the liquid. The supply port-side liquid retaining member 406 is made to have a higher pore density or density of pores than the liquid retaining member 460. According to the magnitude relationship of the pore density, the supply port-side liquid retaining member 406 has greater capillary force than the capillary force of the liquid retaining member 460.

This magnitude relationship of the capillarity force between the supply port-side liquid retaining member 406 and the liquid retaining member 460 causes ink contained in the liquid retaining member 460 to flow in the sequence described below. Ink flows from a member having smaller capillary force to a member having greater capillary force. As shown in FIG. 6, when ink contained in the supply port-side liquid retaining member 406 is sucked via the liquid introducing base 703 to be consumed, ink contained in the liquid retaining member 460 laid on the upper surface of the supply port-side liquid retaining member 406 moves to the supply port-side liquid retaining member 406. The driving force of such ink migration is mainly given by the capillary force of the supply port-side liquid retaining member 406. Such ink migration has no difficulty, due to the air communication through the through hole 402*c* formed corresponding to the location where the liquid retaining member 460 is placed, the air groove 403 continuous with the through hole 402*c* and the air communication hole 434.

Placing the supply port-side liquid retaining member 406 and the liquid retaining member 460 having different characteristics in each of the recesses 421*b*, 421*c*, 421*y* and 421*m* of the casing 420 as described above, in combination with using the metal mesh 703*s* having greater capillary force than the capillarity force of the supply port-side liquid retaining member 406 for the liquid introducing base 703, allows for efficient consumption of ink contained in the liquid retaining member 460. In other words, this reduces the remaining quantity of unused ink in the liquid retaining member 460.

As long as the capillary forces of the supply port-side liquid retaining member 406 and the liquid retaining member 460 are arranged to decrease with an increase in distance from the liquid introducing base 703, the magnitude relationship of the pore density between the respective liquid retaining members 406 and 460 is not limited to the configuration of this embodiment. For example, when the supply port-side liquid retaining member 406 and the liquid retaining member 460 have identical pore densities, the respective liquid retaining members 406 and 460 may be subjected to water repellent treatment or water phobic to have the magnitude relationship of the capillary force described above.

Additionally, as shown in FIGS. 9 and 10, the cartridge 4 has a bottomed groove 480 provided on the bottom surface of the bottom wall 422 (outer wall surface on the −Z direction side) in which the liquid supply ports 407*b*, 407*m*, 407*c* and 407*y* are formed. The bottomed groove 480 is a recessed groove formed in the partition wall 472 and is extended in the +Y direction from the first end wall 423-side. The bottomed groove 480 is formed to have specific depth and length that allow the guide projection 723 of the cartridge attachment structure 7 to be inserted therein in the state that the cartridge 4 is attached to the cartridge attachment structure 7.

The cartridge 4 has a pair of engagement projections 424*t* provided at the lower edge of the outer wall surface of the second end wall 424. In the course of attachment of the cartridge 4 to the cartridge attachment structure 7, the engagement projections 424*t* enter the end wall 730 of the cartridge attachment structure 7 (as shown in FIG. 4) and serve as the supporting point, at which the cartridge 4 is rotated and moved with respect to the cartridge attachment structure 7, to be involved in positioning of the cartridge 4.

A-4. Attachment of Cartridge

Figure 14:
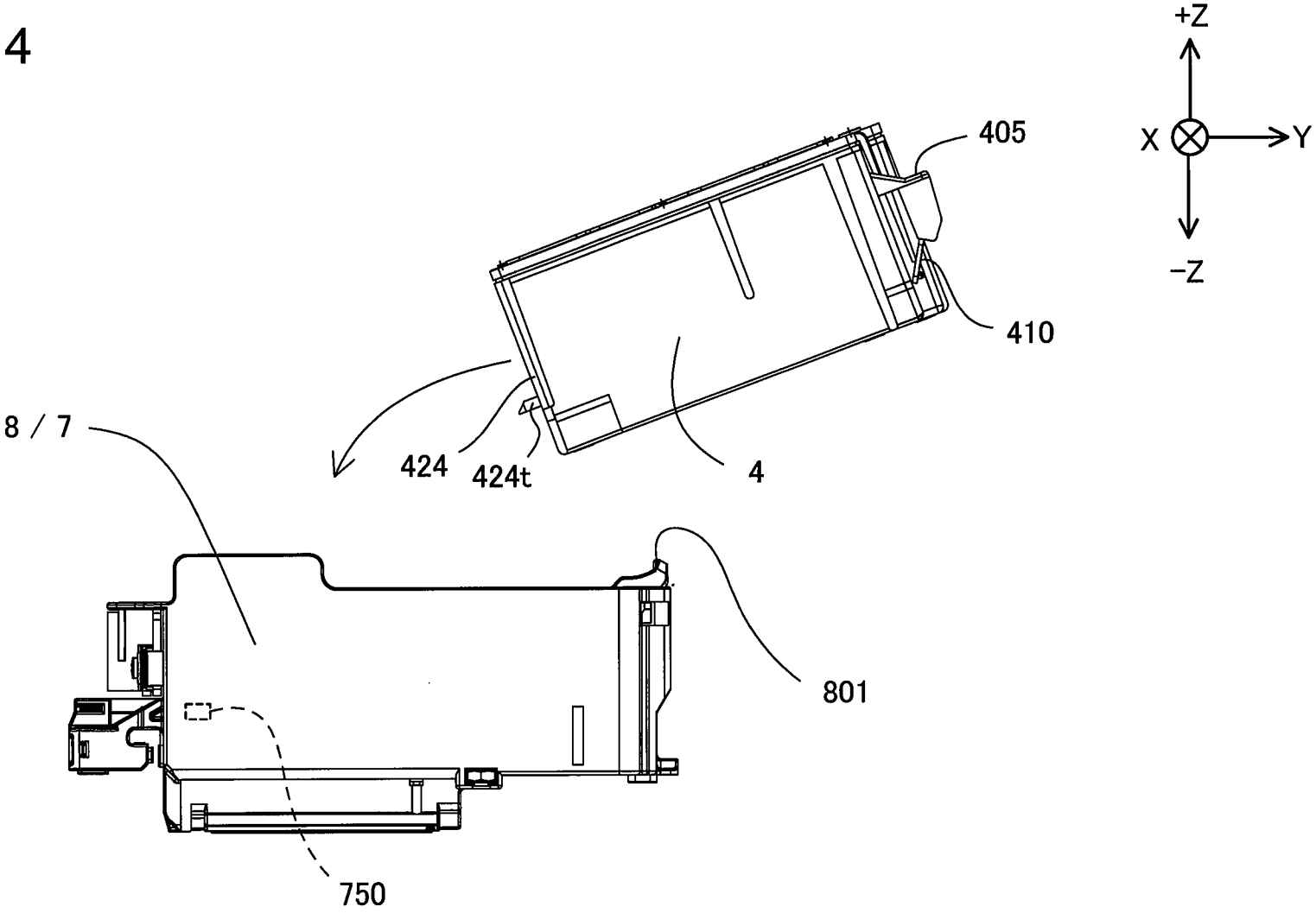
FIG. 14 is a diagram schematically illustrating attachment of the cartridge to the carriage.

FIG. 14 is a diagram schematically illustrating attachment of the cartridge 4 to the carriage 8. As illustrated, in the course of attachment of the cartridge 4, the cartridge 4 is inclined such that the outer wall surface of the second end wall 424 faces in the −Z direction when being inserted into the cartridge attachment structure 7 of the carriage 8. The engagement projections 424*t* of the cartridge 4 are subsequently fit in the engagement holes 750 formed in the cartridge attachment structure 7 of the carriage 8 (as shown in FIG. 4). The cartridge 4 is then pressed in the −Z direction against the cartridge attachment structure 7 until the engagement element 405 is engaged with the cartridge engagement arm 801 as shown in FIG. 6. In this state, the engagement projections 424*t* fit in the engagement holes 750 serve as the supporting point, at which the cartridge 4 is rotated and moved while being pressed as described above.

The cartridge 4 of the embodiment having the configuration described above is mountable to the printer 10 having the liquid introducing parts 710*b*, 710*c*, 710*y* and 710*m* or more specifically the cartridge attachment structure 7 of the carriage 8. The cartridge 4 has the liquid supply ports 407*b*, 407*c*, 407*y* and 407*m* formed in the bottom wall 422 of the casing 420 and allowed to be in contact with these liquid introducing parts 710*b*, 710*c*, 710*y* and 710*m*, and the circuit substrate 410 provided on the second wall surface portion 423*b* of the first end wall 423 intersecting with the bottom wall 422 (as shown in FIG. 9) and allowed to be in electrically contact with the electrode assembly 810 of the carriage 8. In the cartridge 4 of the embodiment, in the plan view of the bottom wall 422 in the first direction toward the bottom wall 422, the distance between the second end wall 424 and the first wall surface portion 423*a* of the first end wall 423 is set to be greater than the distance between the second end wall 424 and the second wall surface portion 423*b*. In the cartridge 4 of the embodiment having this configuration, the circuit substrate 410 is located on the second wall surface portion 423*b* of the first end wall 423, so that the contact-occupying area of the circuit substrate 410 outside of the second wall surface portion 423*b* is overlapped with the range of the above difference in distance in the plan view in the first direction. This configuration of the embodiment accordingly allows for downsizing of the entire cartridge 4 including the liquid supply ports 407 for the respective color inks and the circuit substrate 410 in the plan view in the first direction.

In the cartridge 4 of the embodiment, the above difference between the distances of the first wall surface portion 423*a* and the second wall surface portion 423*b* of the first end wall 423 causes the first wall surface portion 423*a* to be protruded more than the circuit substrate 410 in the direction from the second end wall 424 toward the first end wall 423. This configuration of the cartridge 4 of the embodiment enables the circuit substrate 410 to be protected by the first wall surface portion 423*a* even when an external force due to, for example, a fall is applied to the first end wall 423-side.

In the cartridge 4 of the embodiment, the engagement element 405 to be engaged with the carriage 8 of the printer 10 is provided on the second wall surface portion 423*b* of the first end wall 423. Accordingly, in the cartridge 4 of the embodiment, the engagement element-occupying area of the engagement element 405 outside of the second wall surface portion 423*b* is overlapped with the range of the above difference in distance in the plan view in the first direction. This configuration of the embodiment accordingly allows for downsizing of the entire cartridge 4 in the plan view in the first direction and enables the circuit substrate 410 and the engagement element 405 to be protected by the first wall surface portion 423*a*.

In the course of attachment of the cartridge 4 of the embodiment to the carriage 8 of the printer 10 or more specifically to the cartridge attachment structure 7, the engagement projections 424*t* of the second end wall 424 are fit in the engagement holes 750 of the cartridge attachment structure 7 to serve as the supporting point, at which the cartridge 4 is rotated and moved. Additionally, in the cartridge 4 of the embodiment, as shown in FIG. 12, in the plan view of the bottom wall 422 in the first direction toward the bottom wall 422, the length of the liquid supply port 407*c* in the second direction from the second end wall 424 toward the first end wall 423 is set to be longer than the length of the liquid supply port 407*b* in the second direction. This configuration provides the following advantages. With respect to the liquid supply port 407*c* near to the engagement projection 424*t* serving as the supporting point, in the initial stage of attachment to the cartridge attachment structure 7, i.e., in the stage having the large moving amount of the cartridge 4, the supply port-side liquid retaining member 406 comes into contact with the liquid introducing part 710*c*. This provides the long distance of friction against the liquid introducing part 710*c* in the second direction. With respect to the liquid supply port 407*b* farther from the engagement projection 424*t* serving as the supporting point, on the other hand, in the final stage of attachment, i.e., in the stage having the small moving amount of the cartridge 4, the supply port-side liquid retaining member 406 comes into contact with the liquid introducing part 710*b*. This provides the short distance of friction against the liquid introducing part 710*b* in the second direction. Setting the length of the liquid supply port 407*c* to be longer than the length of the liquid supply port 407*b* in the second direction can respond to the longer distance of friction. This ensures the contact between the liquid introducing part 710*b* and the supply port-side liquid retaining member 406 with respect to the liquid supply port 407*b* farther from the supporting point.

In the cartridge 4 of the embodiment, the recess 421*c* for cyan ink and the recess 421*b* for black ink are arrayed between the second end wall 424 and the second wall surface portion 423*b* of the first end wall 423 as shown in FIG. 12, and the capacity of the recess 421*c* is made larger than the capacity of the recess 421*b*. This configuration of the cartridge 4 of the embodiment allows for downsizing of the entire cartridge 4 with the difference in capacities of the recesses.

In the cartridge 4 of the embodiment, as shown in FIG. 12, the recess 421*y* for yellow ink and the recess 421*m* for magenta ink are arrayed between the second end wall 424 and the first wall surface portion 423*a* of the first end wall 423, and the recess 421*c* for cyan ink and the recess 421*b* for black ink are arrayed between the second end wall 424 and the second wall surface portion 423*b*. Additionally, in the cartridge 4 of the embodiment, the recesses 421*y*, 421*m* and 421*c* are made to have the larger capacities than the capacity of the recess 421*b*. The respective color inks are contained in these recesses 421*y*, 421*m* and 421*c* of the larger capacities, and the black ink is contained in the recess 421*b*. This configuration provides the following advantages. In color printing using a plurality of different color inks, the amounts of consumption of the color inks, i.e., magenta ink, yellow ink and cyan ink, are generally larger than the amount of consumption of black ink. In the cartridge 4 of the embodiment, black ink is contained in the recess 421*b* of the smaller capacity, and the respective color inks are contained in the recesses 421*c*, 421*y* and 421*m* of the larger capacities. This configuration of the cartridge 4 of the embodiment allows for downsizing of the entire cartridge 4 and additionally enhances the flexibility of color printing.

In the cartridge 4 of the embodiment, in the plan view of the bottom wall 422 in the first direction, the recesses 421*c*, 421*y* and 421*m* are formed in square shape. This provides the following advantages. In the case that each color ink is supplied from the liquid retaining member 460 placed in the corresponding recess 421*c*, 421*y* or 421*m* through the supply port-side liquid retaining members 406 to the liquid introducing part 710*c*, 710*y* or 710*m*, the recess 421*c*, 421*y* or 421*m* formed in rectangular shape causes a difference between the distance from the longer side end of the liquid retaining member 460 placed in the recess 421*c*, 421*y* or 421*m* to the corresponding liquid introducing part 710*c*, 710*y* or 710*m* and the distance from the shorter side end of the liquid retaining member 460 to the corresponding liquid introducing part 710*c*, 710*y* or 710*m*. This results in a difference in ink supply efficiency, which is increased with an increase in ratio of the longer side to the shorter side. Forming the recesses 421*c*, 421*y* and 421*m* and the liquid retaining members 460 placed therein in square shape, however, causes no significant difference between the above distances. This configuration of the cartridge 4 of the embodiment allows for downsizing of the entire cartridge 4 as described above and moreover enhances the supply efficiency of ink retained in the liquid retaining member 460 placed in the recess 421*c*, 421*y* or 421*m*. Forming the recesses 421*c*, 421*y* and 421*m* and the liquid retaining members 460 placed therein in square shape in the plan view also increases the volume efficiency of the liquid retaining members 460. This is advantageous for further downsizing of the entire cartridge 4.

B. Modifications

The invention may be implemented by any of various aspects described below.

B-1. Cartridges Using Outer Casing

Figure 15:
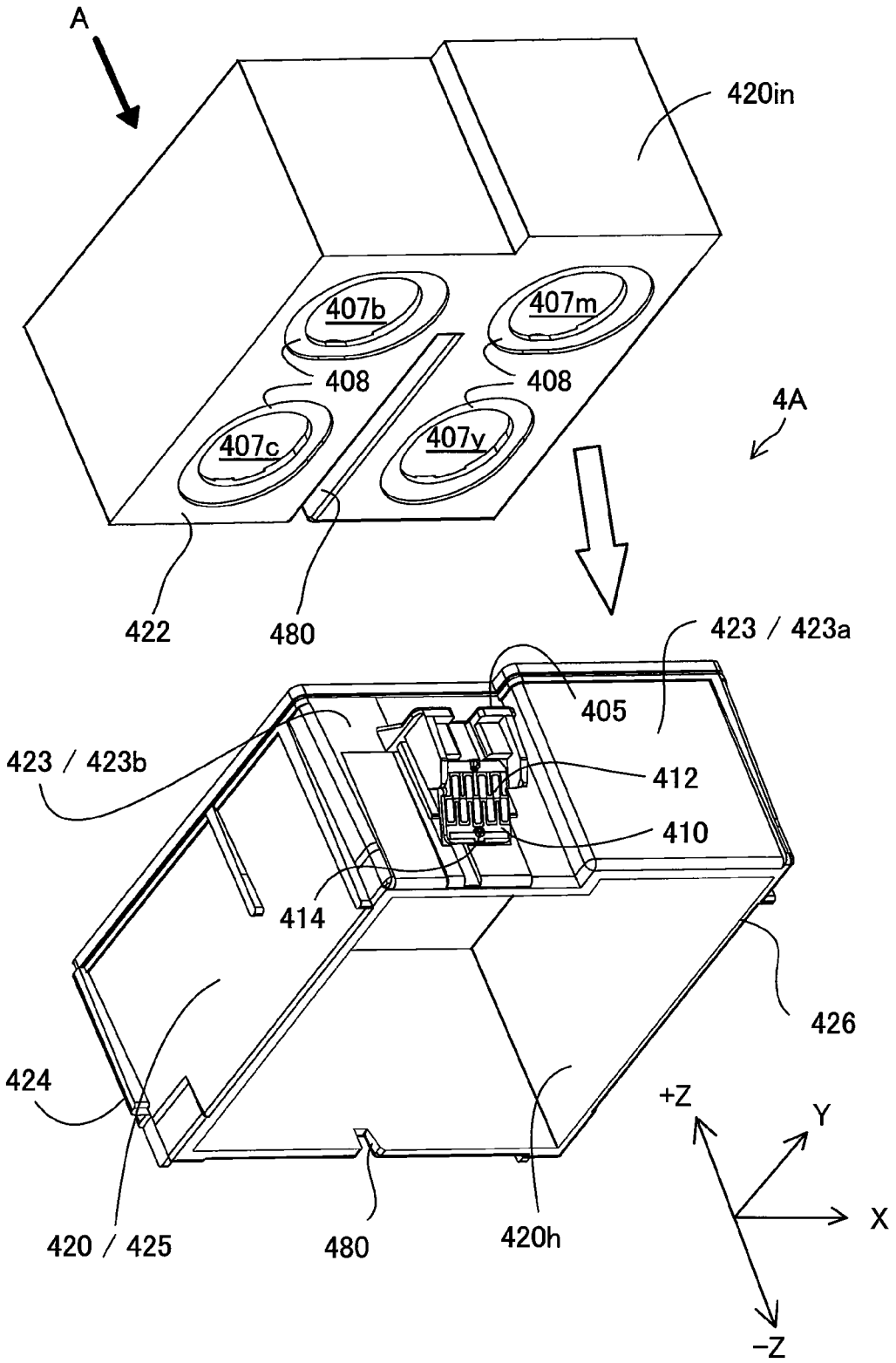
FIG. 15 is a schematic exploded view illustrating a cartridge using an outer casing according to a first modification.
Figure 16:
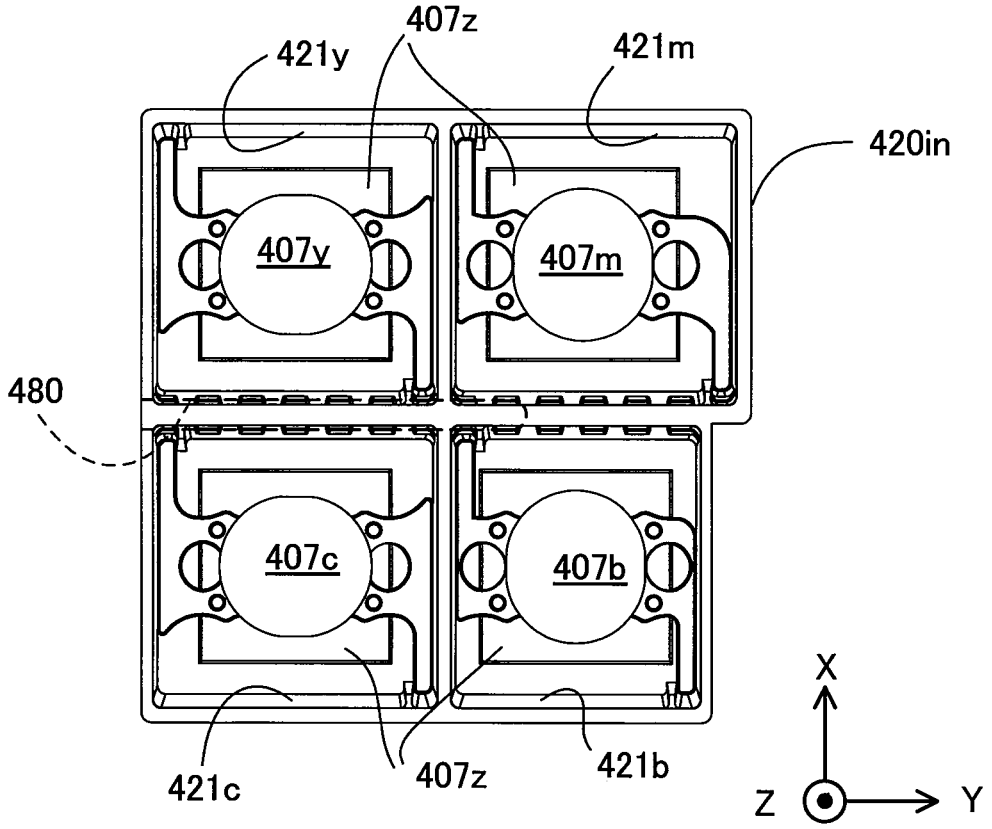
FIG. 16 is a plan view illustrating an inner casing taken in a direction A in FIG. 15.

FIG. 15 is a schematic exploded view illustrating a cartridge 4A using an outer casing according to a first modification. FIG. 16 is a plan view illustrating an inner casing taken in a direction A in FIG. 15. This cartridge 4A includes an outer casing 420out and an inner casing 420in. The outer casing 420out has the appearance similar to that of the casing 420 described above except the bottom wall 422 and includes a casing insertion opening 420*h* in addition to a first wall surface portion 423*a* and a second wall surface portion 423*b* of a first end wall 423. The inner casing 420in has a recess 421*b*, 421*m*, 421*c* and 421*y* formed to contain the respective color inks, black, magenta, cyan and yellow, and additionally has liquid supply ports 407*b*, 407*m* 407*c* and 407*y* and a bottomed groove 480 formed in the bottom wall 422. The inner casing 420in has a side wall in step-like outer shape conforming to the outer shape of the first wall surface portion 423*a* and the second wall surface portion 423*b*. The arrangement of the respective recesses and the shapes of the liquid supply ports are similar to the casing 420 described above. The outer casing 420out has a circuit substrate 410 provided on the second wall surface portion 423*b* and arranged to be in electrically contact with the electrode assembly 810 of the carriage 8. The inner casing 420in is detachably mounted to the outer casing 420out by insertion of the inner casing 420in into the casing insertion opening 420*h*. The cartridge 4A having the inner casing 420in inserted in the casing insertion opening 420*h* of the outer casing 420out is compatible with the cartridge 4 described above. Positioning pins, steps or the like (not shown) may be formed between the outer wall surface of the inner casing 420in and the inner wall surface of the casing insertion opening 420*h* to position the inner casing 420in in the Z-axis direction.

With respect to the cartridge 4A of this modification, in response to consumption of the respective color inks, replacement of only the inner casing 420in is needed for ink refill. The multi-part configuration of the cartridge 4A divided into the inner casing 420in and the outer casing 420out has the advantageous effects such as downsizing described above.

Figure 17:
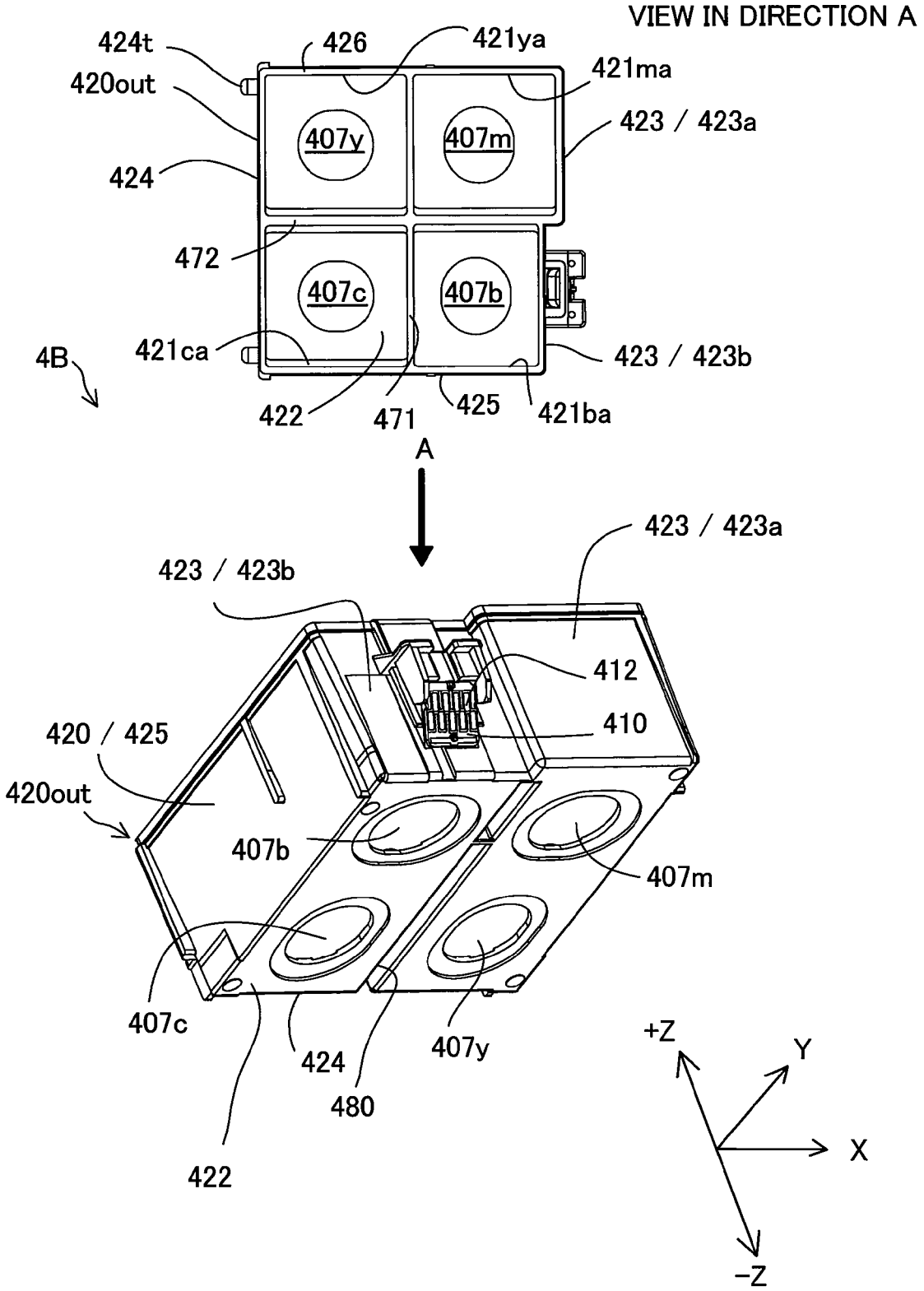
FIG. 17 is a perspective view illustrating another cartridge using an outer casing according to a second modification, viewed from the bottom surface side of the outer casing, and a view taken in a direction of arrow A.
Figure 18:
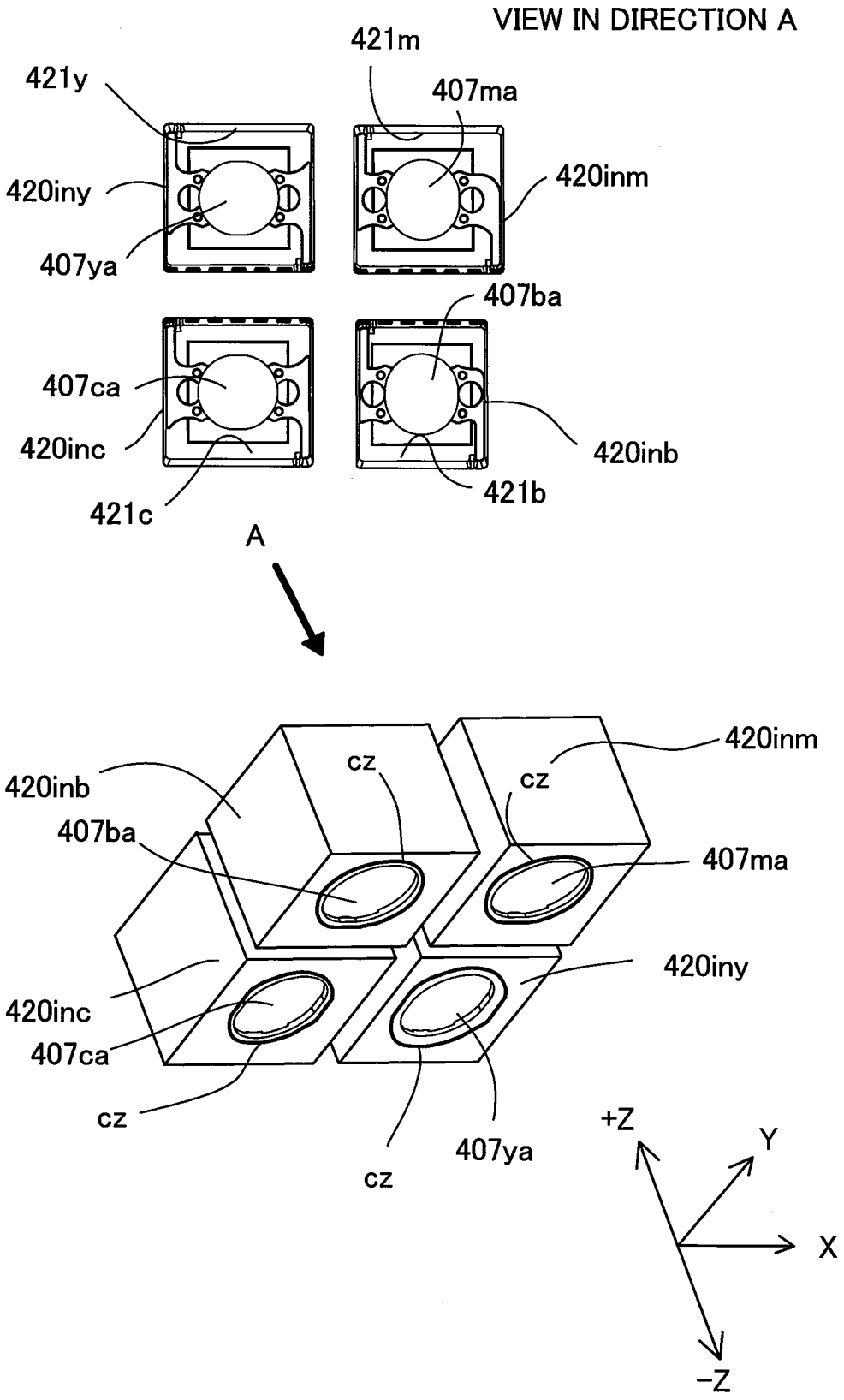
FIG. 18 is a perspective view illustrating inner casings of respective colors in the cartridge of the second modification, viewed from the bottom surface side, and a view taken in a direction of arrow A.
Figure 19:
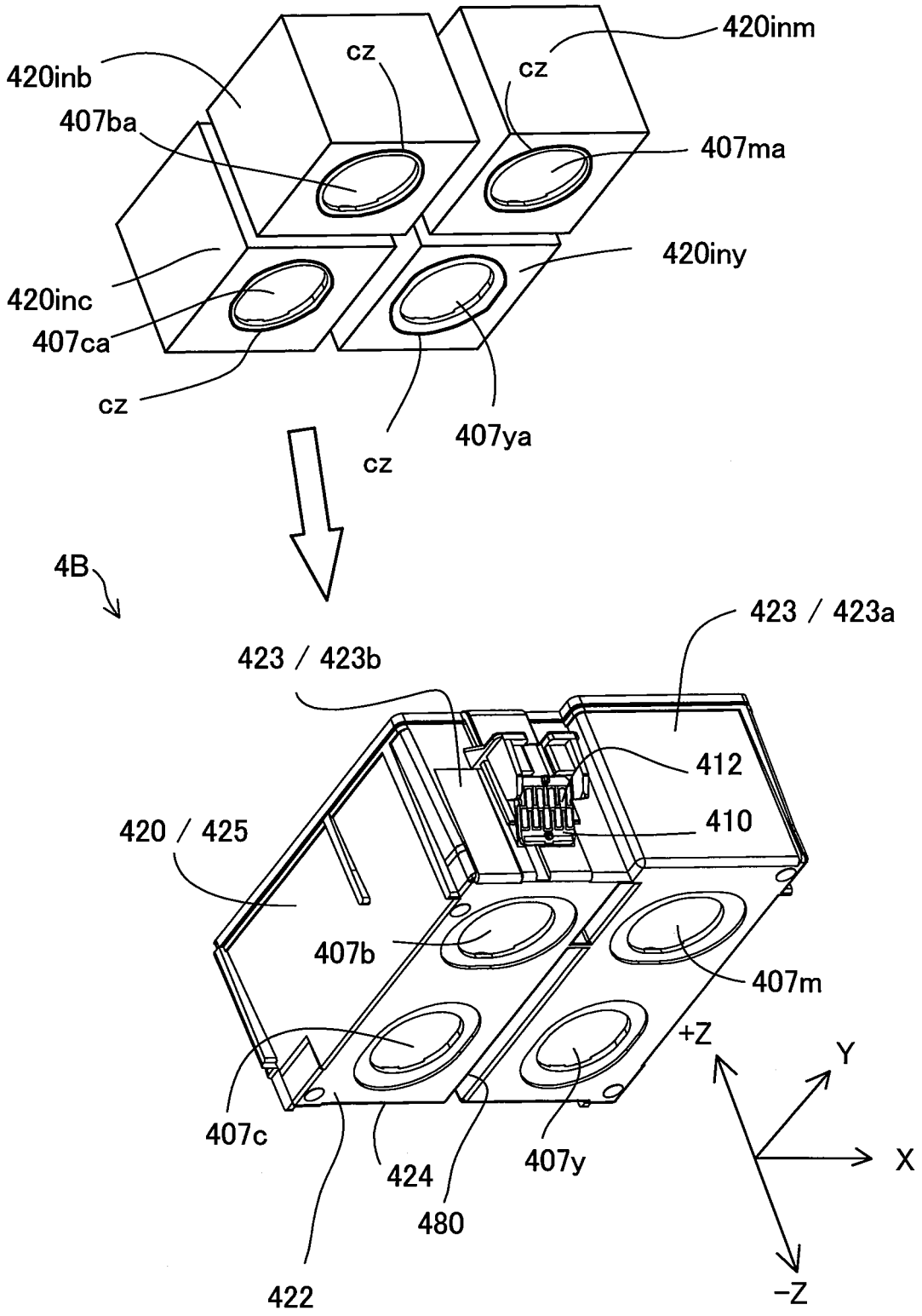
FIG. 19 is a schematic exploded view illustrating the cartridge of the second modification.

FIG. 17 is a perspective view illustrating another cartridge 4B using an outer casing according to a second modification, viewed from the bottom surface side of the outer casing, and a view taken in a direction of arrow A. FIG. 18 is a perspective view illustrating inner casings of respective colors in the cartridge 4B of the second modification, viewed from the bottom surface side, and a view taken in a direction of arrow A. FIG. 19 is a schematic exploded view illustrating the cartridge 4B of the second modification. The cartridge 4B includes an outer casing 420out and inner casings 420*inb*, 420*inm*, 420*inc* and 420*iny*. The outer casing 420out has the appearance including the bottom wall 422, similar to that of the casing 420 described above. As shown in FIG. 17, the outer casing 420out has liquid supply ports 407*b*, 407*m* 407*c* and 407*y* and a bottomed groove 480 formed in the bottom wall 422 and a circuit substrate 410 arranged to be in electrically contact with the electrode assembly 810 of the carriage 8. The shapes of the respective liquid supply ports and the position and the shape of the circuit substrate 410 are similar to those of the casing 420 described above. The outer casing 420out has casing receiving recesses 421*ba*, 421*ma*, 421*ca* and 421*ya* formed by the bottom wall 422, the first end wall 423, the second end wall 424, the first side wall 425 and the second side wall 426 surrounding the bottom wall 422, and the partition walls 471 and 472 to individually receive the inner casings 420*inb*, 420*inm*, 420*inc* and 420*iny* described below. These casing receiving recesses 421*ba*, 421*ma*, 421*ca* and 421*ya* should be arranged to receive the respective inner casings 420*inb*, 420*inm*, 420*inc* and 420*iny* in the liquid tight state, so that the inner wall surface of the bottom wall 422 forms a plane.

The inner casing 420*inb* has the appearance allowed to be inserted in the casing receiving recess 421*ba* of the outer casing 420out and a recess 421*b* having the inner shape similar to that of the recess 421*b* of the casing 420 described above to receive the liquid retaining member 460 and the supply port-side liquid retaining member 406 placed therein. The inner casing 420*inb* has a through hole 407*ba* which is to be aligned with the liquid supply port 407*b* of the outer casing 420out and has its circumference sealed by a seal member cz. In the state that the inner casing 420*inb* is placed in the casing receiving recess 421*ba* of the outer casing 420out, black ink is supplied through the through hole 407*ba* sealed with the seal member cz and the liquid supply port 407*b* to the liquid introducing part 710*b* of the carriage 8 (as shown in FIG. 4). The same applies to the inner casings 420*inc*, 420*iny* and 420*inm*.

The assembly of the inner casing 420*inb*, the inner casing 420*inm*, the inner casing 420*inc* and the inner casing 420*iny* is mountable to the liquid supply port 407*b*, the liquid supply port 407*m*, the liquid supply port 407*c* and the liquid supply port 407*y*. Black ink is supplied through the liquid supply port 407*b* to the liquid introducing part 710*b* of the carriage 8 (as shown in FIG. 4). Similarly, magenta ink is supplied through the liquid supply port 407*m* to the liquid introducing part 710*m* of the carriage 8; cyan ink is supplied through the liquid supply port 407*c* to the liquid introducing part 710*c*; and yellow ink is supplied through the liquid supply port 407*y* to the liquid introducing part 710*y*. The cartridge 4B is obtained by placing the inner casings 420*inb*, 420*inm*, 420*inc* and 420*iny* in the corresponding casing receiving recesses 421*ba*, 421*ma*, 421*ca* and 421*ya* of the outer casing 420out, as shown in FIG. 19. The obtained cartridge 4B is compatible with the cartridge 4 described above. Positioning pins, steps or the like (not shown) may be formed between the inner wall surfaces of the casing receiving recesses 421*ba*, 421*ma*, 421*ca* and 421*ya* of the outer casing 420out and the outer wall surfaces of the inner casings 420*inb*, 420*inm*, 420*inc* and 420*iny* to position the respective inner casings 420*inb*, 420*inm*, 420*inc* and 420*iny* in the Z-axis direction.

With respect to the cartridge 4B of this modification, in response to consumption of the respective color inks, replacement of only the inner casings 420*inb*, 420*inm*, 420*inc* and 420*iny* is needed for ink refill. The multi-part configuration of the cartridge 4B divided into the inner casings 420*inb*, 420*inm*, 420*inc* and 420*iny* has the advantageous effects such as downsizing described above. The inner casings 420*inb*, 420*inm*, 420*inc* and 420*iny* of the second modification may be integrated as an integral component.

Figure 20:
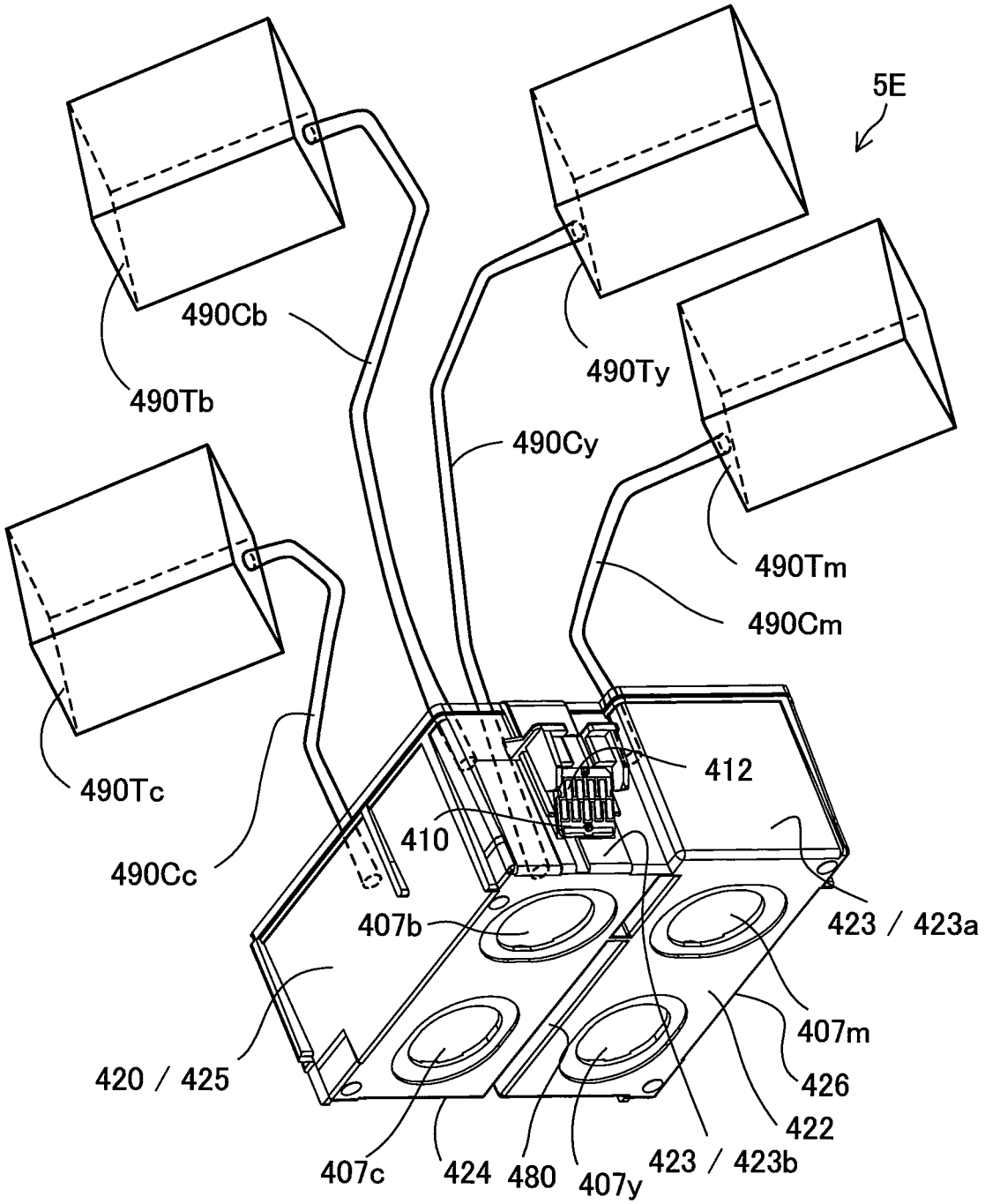
FIG. 20 is a schematic exploded view illustrating another cartridge using an outer casing according to a third modification.

FIG. 20 is a schematic exploded view illustrating another cartridge 4C using an outer casing according to a third modification. This cartridge 4C has the inner casings 420*inb*, 420*inm*, 420*inc* and 420*iny* placed in the outer casing 420out of the second modification, and additionally has external tanks 490Tb, 490Tm, 490Tc and 490Ty for the respective color inks, black, magenta, cyan and yellow and tubes 490Cb, 490Cm, 490Cc and 490Cy for the corresponding color inks. The external tanks 490Tb, 490Tm, 490Tc and 490Ty contain the respective color inks and supply the contained inks by built-in pumps (not shown) through the tubes 490Cb, 490Cm, 490Cc and 490Cy to the inner casings 420*inb*, 420*inm*, 420*inc* and 420*iny*. As described above, the inner casings 420*inb*, 420*inm*, 420*inc* and 420*iny* have the through holes 408*ba*, 407*ma*, 407*ca* and 407*ya* (as shown in FIG. 19), which are arranged to communicate with the liquid supply ports 407*b*, 407*m*, 407*c* and 407*y* of the outer casing 420out. Accordingly, the external tank 490Tb and the tube 490Cb are mountable to the liquid supply port 407*b*; the external tank 490Tm and the tube 490Cm are mountable to the liquid supply port 407*m*; the external tank 490Tc and the tube 490Cc are mountable to the liquid supply port 407*c*; and the external tank 490Ty and the tube 490Cy are mountable to the liquid supply port 407*y*. Black ink is supplied through the liquid supply port 407*b* to the liquid introducing part 710*b* of the carriage 8 (as shown in FIG. 4). Similarly, magenta ink is supplied through the liquid supply port 407*m* to the liquid introducing part 710*m* of the carriage 8; cyan ink is supplied through the liquid supply port 407*c* to the liquid introducing part 710*c*; and yellow ink is supplied through the liquid supply port 407*y* to the liquid introducing part 710*y*. The multi-part configuration of the cartridge 4C has the advantageous effects such as downsizing described above.

B-2. Other Modifications

The present invention is not limited to the inkjet printer or its ink cartridges but is also applicable to any liquid ejection device configured to eject another liquid but ink and a cartridge (liquid container) configured to contain another liquid. For example, the invention may be applied to any of various liquid ejection devices and their liquid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) liquid ejection device configured to eject a bioorganic material-containing liquid used for manufacturing biochips;

(5) sample ejection device used as a precision pipette;

(6) ejection device of lubricating oil;

(7) ejection device of a resin solution;

(8) liquid ejection device for pinpoint ejection of lubricating oil on precision machines such as watches or cameras;

(9) liquid ejection device configured to eject a transparent resin solution, such as an ultraviolet curable resin solution, onto a substrate in order to manufacture a hemispherical microlens (optical lens) used for, for example, optical communication elements;

(10) liquid ejection device configured to eject an acidic or alkaline etching solution in order to etch a substrate or the like; and

(11) liquid ejection device equipped with a liquid ejection head for ejecting a very small volume of droplets of any other liquid.

The "droplet" herein means the state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, liquid materials in sol-gel process and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks.

The invention is not limited to any of the embodiment, the examples and the modifications described herein but may be implemented by a diversity of other configurations without departing from the scope of the invention. For example, the technical features of the embodiment, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A liquid supply unit configured to supply liquid and mountable to a liquid ejection device comprising a first liquid introducing part, a second liquid introducing part, a third liquid introducing part, a fourth liquid introducing part and an engagement arm, the engagement arm configured to be rotated and displaced to be engaged with the liquid supply unit, the liquid supply unit comprising:

a bottom wall comprising a first liquid supply section configured to be in contact with the first liquid introducing part, a second liquid supply section configured to be in contact with the second liquid introducing part, a third liquid supply section configured to be in contact with the third liquid introducing part and a fourth liquid supply section configured to be in contact with the fourth liquid introducing part;

a first end wall arranged to intersect with the bottom wall and configured to have a first end wall surface portion and a second end wall surface portion;

a second end wall arranged to intersect with the bottom wall and to be opposed to the first end wall; and an engagement part having an engagement surface facing in the opposite direction as the bottom wall, located on and projecting outward from the second end wall surface portion, the engagement part configured to engage with the engagement arm when the liquid supply unit is mounted to the liquid ejection device, wherein the distance between the second end wall and the first end wall surface portion is greater than the distance between the second end wall and the second end wall surface portion when viewed in a plan view of the bottom wall in a first direction toward the bottom wall, whereby the first end wall surface portion is offset outwards, with respect to the second end wall surface portion, in said plan view.

2. The liquid supply unit according to claim 1, wherein the liquid supply unit is adapted and configured such that in the course of attachment of the liquid supply unit to the liquid ejection device, the second end wall has a supporting point at which the liquid supply unit can be rotated and moved with respect to the liquid ejection device, in the plan view of the bottom wall in the first direction toward the bottom wall, the first liquid supply section and the third liquid supply section are located between the second end wall and the first end wall surface portion, and the second liquid supply section and the fourth liquid supply section are located between the second end wall and the second end wall surface portion, wherein a length of the fourth liquid supply section in a second direction from the second end wall toward the first end wall is longer than the length of the second liquid supply section in the second direction.

3. The liquid supply unit according to claim 2, further comprising:

a first liquid chamber connected with the first liquid supply section;

a second liquid chamber connected with the second liquid supply section;

a third liquid chamber connected with the third liquid supply section; and a fourth liquid chamber connected with the fourth liquid supply section, wherein the first liquid chamber has a larger capacity than capacity of the second liquid chamber.

4. The liquid supply unit according to claim 2, further comprising:

a first liquid chamber connected with the first liquid supply section;

a second liquid chamber connected with the second liquid supply section;

a third liquid chamber connected with the third liquid supply section; and a fourth liquid chamber connected with the fourth liquid supply section, wherein the first liquid chamber, the third liquid chamber and the fourth liquid chamber have larger capacities than capacity of the second liquid chamber, the first liquid chamber, the third liquid chamber and the fourth liquid chamber contain color inks, and the second liquid chamber contains black ink.

5. The liquid supply unit according to claim 4, wherein in the plan view of the bottom wall in the first direction, the first liquid chamber, the third liquid chamber and the fourth liquid chamber are formed in square shape.

* * * * *